US007591072B2

(12) United States Patent
Stravitz

(10) Patent No.: US 7,591,072 B2
(45) Date of Patent: Sep. 22, 2009

(54) CUTTING DEVICES

(76) Inventor: David M. Stravitz, 16 Park Ave., New York, NY (US) 10016

( * ) Notice: Subject to any disclaimer, the term of this patent is extended or adjusted under 35 U.S.C. 154(b) by 476 days.

(21) Appl. No.: 11/251,642

(22) Filed: Oct. 14, 2005

(65) Prior Publication Data

US 2006/0090345 A1 May 4, 2006

Related U.S. Application Data

(60) Provisional application No. 60/689,338, filed on Jun. 10, 2005, provisional application No. 60/619,248, filed on Oct. 15, 2004.

(51) Int. Cl.

| | |
|---|---|
| ***B26B 21/00*** | (2006.01) |
| ***B26B 3/00*** | (2006.01) |
| ***B26B 1/00*** | (2006.01) |
| ***B26D 11/00*** | (2006.01) |

(52) U.S. Cl. ..... 30/50; 30/301; 30/304; 30/307; 30/316; 30/320; 83/863; 83/864

(58) Field of Classification Search ..... 30/301, 30/304, 307, 316, 319, 320, 292, 299, 306, 30/265; 83/863, 864

See application file for complete search history.

(56) References Cited

U.S. PATENT DOCUMENTS

| | | | | | |
|---|---|---|---|---|---|
| 690,489 | A | * | 1/1902 | Vander Wee | 7/158 |
| 714,729 | A | | 12/1902 | Millhiser | |
| 1,362,174 | A | * | 12/1920 | Mosovsky | 30/307 |
| 1,681,667 | A | * | 8/1928 | Carman et al. | 12/103 |
| 2,568,353 | A | | 9/1951 | Miseta, Jr. | |
| 2,571,527 | A | | 10/1951 | Boyer | |
| 2,713,903 | A | * | 7/1955 | Smith | 83/499 |
| 2,905,211 | A | * | 9/1959 | Weinstein | 144/48.3 |
| 3,230,620 | A | | 1/1966 | McKinley | |
| 3,459,087 | A | * | 8/1969 | Weisner | 83/451 |
| 3,644,994 | A | * | 2/1972 | Lind | 30/292 |
| 4,028,802 | A | | 6/1977 | Houghton et al. | |
| 4,155,142 | A | * | 5/1979 | Demetriadis | 15/236.06 |
| 5,101,564 | A | | 4/1992 | Melter | |

(Continued)

OTHER PUBLICATIONS

Description of Olfa (CMP-3) Rotary Circle Cutter.

(Continued)

*Primary Examiner*—Ghassem Alie
*Assistant Examiner*—Bharat C Patel
(74) *Attorney, Agent, or Firm*—Brian Roffe

(57) ABSTRACT

Cutting devices including an elongate body having a handle and two rotatable cutting blades mounting on opposite sides of the body. One cutting blade is movable longitudinally relative to the other to enable variation in the longitudinal spacing between the cutting blades. In addition to or instead of the variable longitudinal spacing, one cutting blade is movable transversely relative to the other to enable variation in the transverse spacing between the cutting blades. Other cutting devices include a housing defining a blade-receiving cavity, an actuating mechanism pivotally mounted to the housing and a cutting assembly arranged in the cavity and including cutting blades. The cutting assembly is rotatable relative to the housing to selectively bring each cutting blade into a cutting position, and has a relaxed position in which the cutting blades are recessed within an outer periphery of the housing. The cutting assembly is biased into this relaxed position.

10 Claims, 25 Drawing Sheets

U.S. PATENT DOCUMENTS

| | | | | |
|---|---|---|---|---|
| 5,259,255 | A * | 11/1993 | Urban et al. | 74/37 |
| 5,299,355 | A | 4/1994 | Boda et al. | |
| 5,322,001 | A | 6/1994 | Boda | |
| 5,355,588 | A | 10/1994 | Brandenburg, Jr. | |
| D388,305 | S | 12/1997 | Schulz et al. | |
| 5,711,077 | A | 1/1998 | Schulz et al. | |
| 5,765,289 | A | 6/1998 | Schulz et al. | |
| D412,274 | S | 7/1999 | Okada | |
| 6,102,023 | A * | 8/2000 | Ishiwata et al. | 125/13.01 |
| 6,189,218 | B1 | 2/2001 | Okada | |
| 6,233,832 | B1 | 5/2001 | Berns | |
| 6,282,794 | B1 | 9/2001 | Cho et al. | |
| 6,298,561 | B1 * | 10/2001 | Decker | 30/265 |
| 6,460,254 | B1 | 10/2002 | Mori et al. | |
| 6,584,694 | B2 | 7/2003 | Chen | |
| 6,643,936 | B2 | 11/2003 | Carlson | |
| 6,708,410 | B2 | 3/2004 | Okada | |
| 6,889,440 | B2 | 5/2005 | Okada | |
| 6,939,199 | B2 * | 9/2005 | Peng et al. | 451/5 |
| 2003/0233756 | A1 * | 12/2003 | Muhlebach | 30/265 |
| 2005/0108883 | A1 | 5/2005 | Okada | |

OTHER PUBLICATIONS

Review of Olfa Compass Cutter (model CMP-3), Mar. 8, 2004.
Review of Olfa Compass Cutter CMP-1, Feb. 25, 2002.
Picture of Grifhold Dual Cutter 88.

* cited by examiner

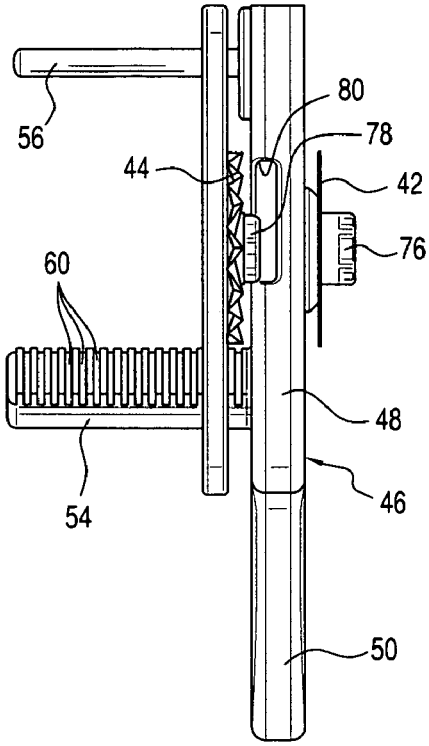
FIG. 9
FIG. 10
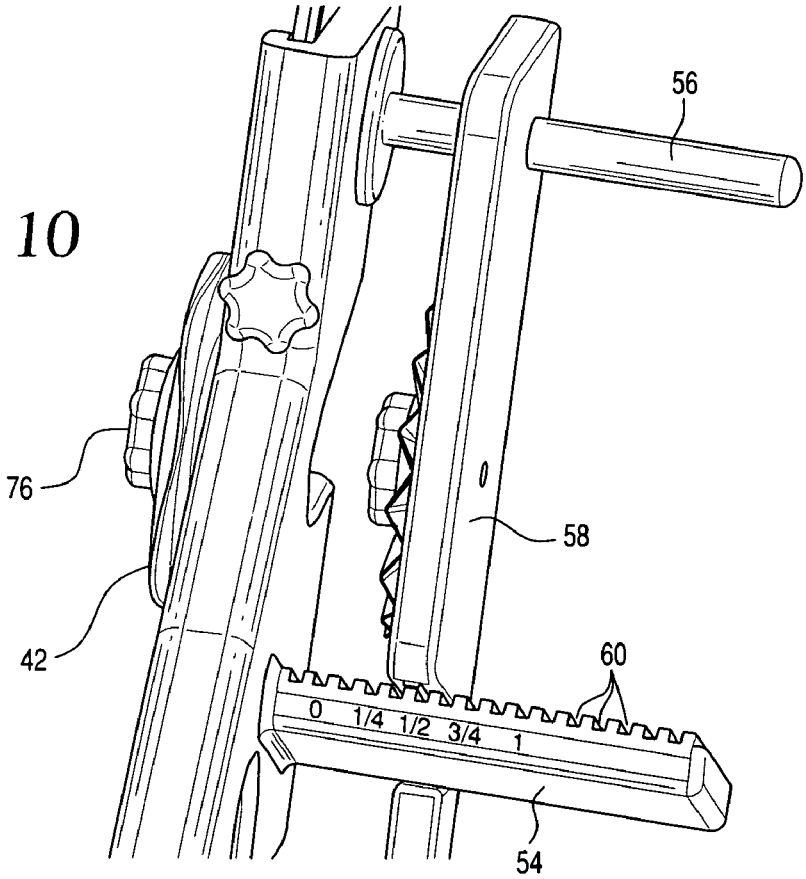

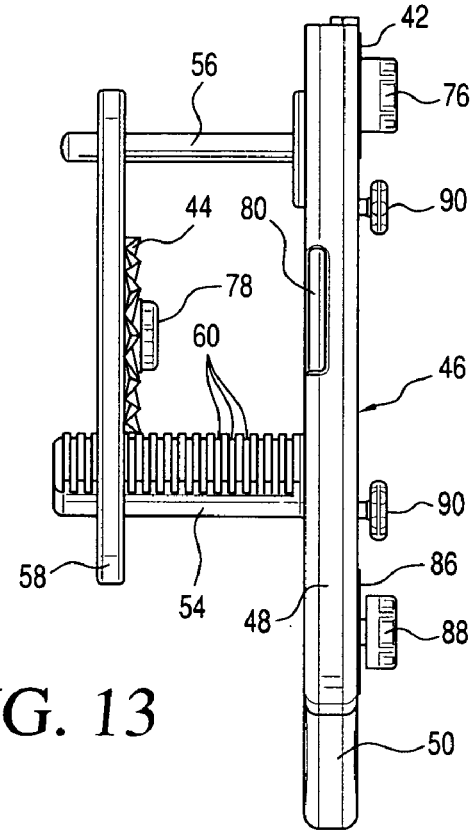
FIG. 13
FIG. 14
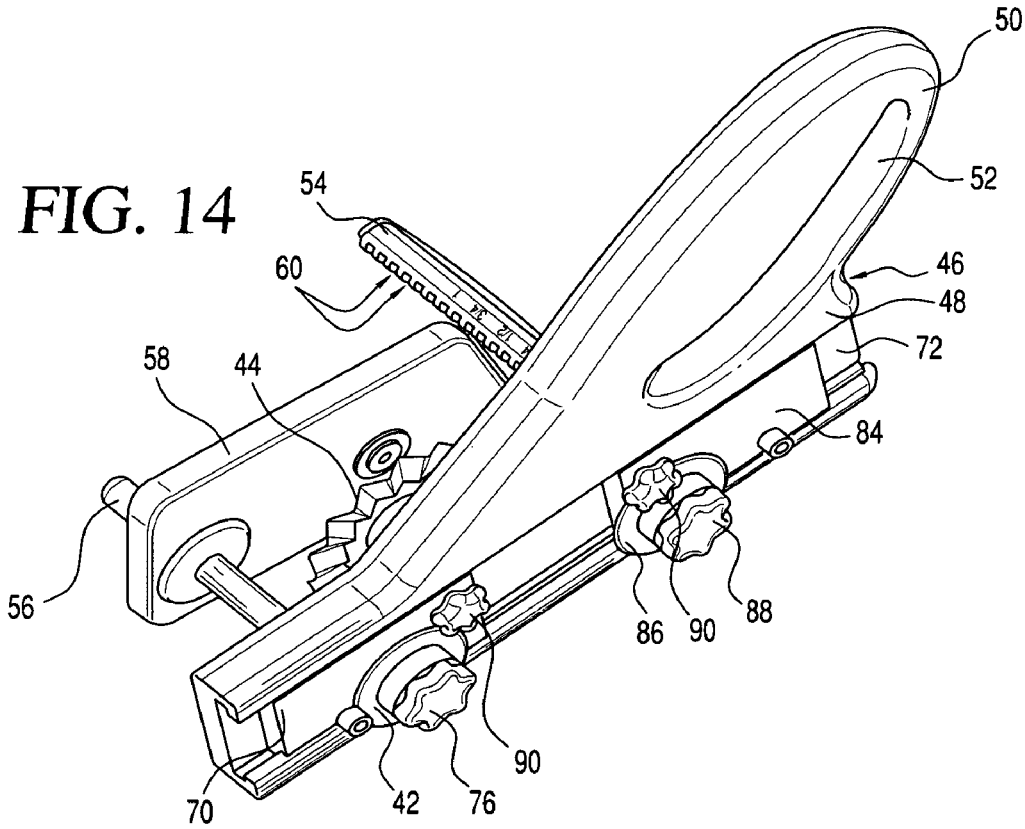

FIG. 28
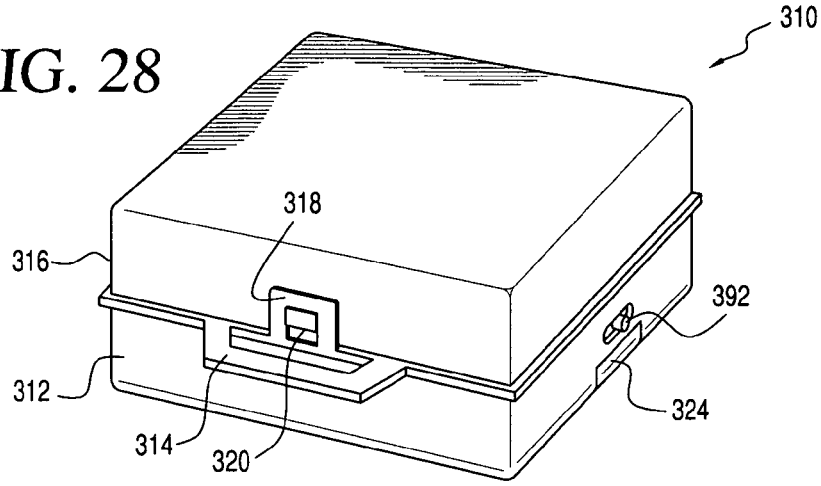
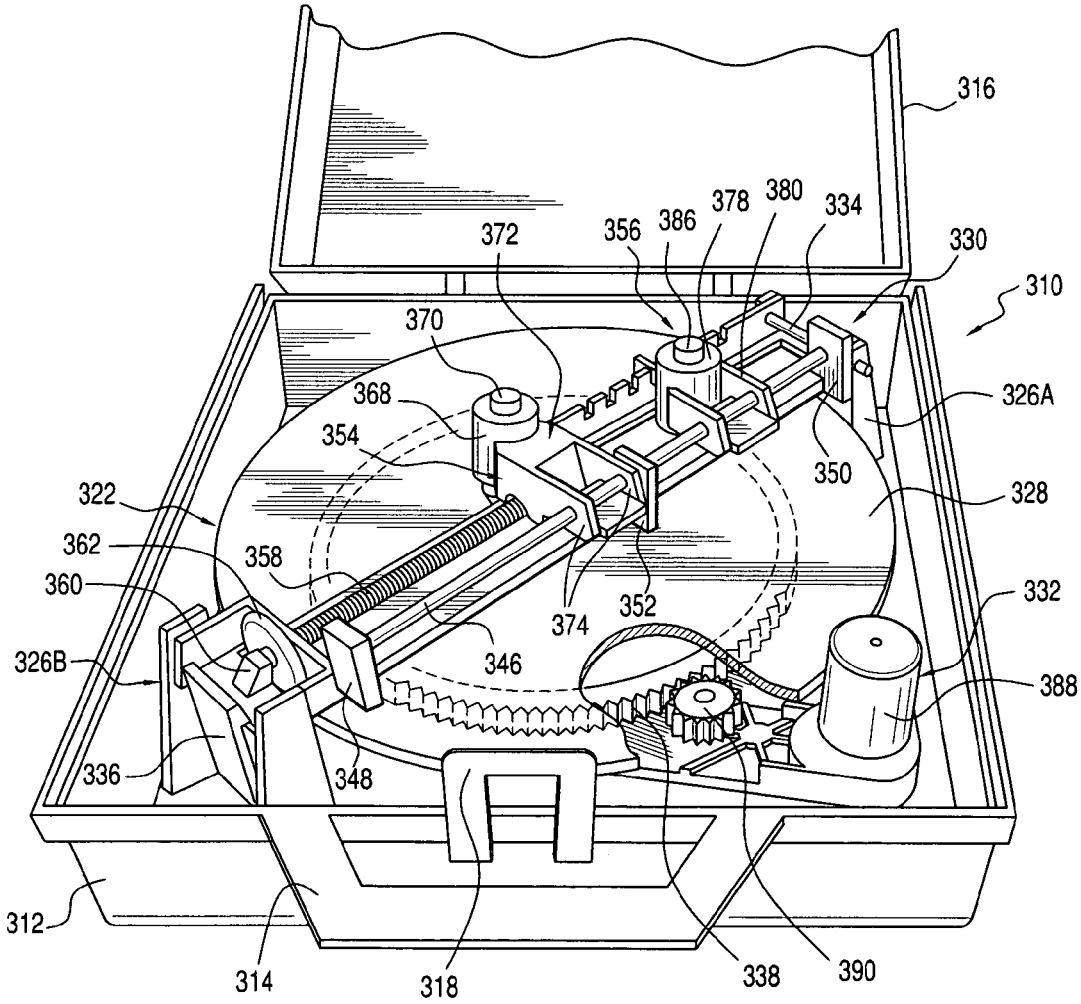
FIG. 29

CUTTING DEVICES

CROSS REFERENCE TO RELATED APPLICATIONS

This application claims priority under 35 U.S.C. § 119(e) of U.S. provisional patent application Ser. No. 60/619,248 filed Oct. 15, 2004 and U.S. provisional patent application Ser. No. 60/689,338 filed Jun. 10, 2005, both of which are incorporated by reference herein.

FIELD OF THE INVENTION

The present invention relates generally to cutting devices for cutting sheet material and in particular to cutting devices which are capable of simultaneously making multiple cuts in a substrate.

The present invention also relates generally to fashioning devices which modify planar substrates into particular shapes and/or forms and/or provide them with designs and more particularly to fashioning devices which cut, scribe and/or emboss planar substrates in a spiral and/or circular manner. Thus, fashioning devices in accordance with the invention include cutting devices for cutting sheet material to make a single circular or spiral cut or simultaneously make multiple circular cuts alone or in combination with a spiral cut.

BACKGROUND OF THE INVENTION

Hand-held cutting devices are used in various industries and hobbies such as quilting, sewing and scrapbooking, and are also often used by graphic artists, architects, model makers and the like. Basic types of hand-held cutting device include scissors, rotary cutters and Exacto knives which are typically used to make single cuts in sheet material or other substrates.

Rotary cutters typically have a hand-held body, a circular blade mounted on an actuating member at a front of the body and a mechanism for moving the actuating member from a safety position to an operative position. Rotary cutters are made by Fiskars and Olfa Corp. and some are described in U.S. Pat. Nos. 5,101,564, 5,299,355, 5,355,588, 5,711,077, 5,765,289, 6,189,218, 6,282,794, Des. 388,305 and Des. 412, 274.

Special cutting devices have been developed to make multiple cuts simultaneously, e.g., a pair of parallel cuts, and to make perfectly circular cuts.

One hand-held cutting device of the first type is a Grifhold Dual Cutter 88 which includes a handle, a fork member defining two prongs having integral cutting blades at its ends and an adjustment screw for adjusting the distance between the prongs and thus the distances between the blades. By drawing the blades over a sheet of material, two parallel cuts are formed. A disadvantage of this cutting device is that the distance between the blades, i.e., the maximum cutting width, is limited.

Several cutting devices of the second type which made by Olfa and include a compass cutter designated CMP-1 which is capable of forming an interior circular cut in a substrate. This compass cutter includes a beam, a pivot point fixture which slides along the beam and a single rotatable cutting blade fixed at one end of the beam. A handle is integrated with the pivot point fixture. The radius of the cut-out is determined and the pivot point fixture is slid to a position at which the distance between the pivot point fixture and blade is equal to the radius and then fixed in position. Rotation of the blade about the pivot point fixture thereby forms a circular cut-out in the substrate.

Another Olfa cutting device for making perfectly circular cuts is designated CMP-3 and referred to as a rotary circle cutter. In this cutting device, the handle is separated from the pivot point fixture to enable easier use of the device.

A rotary circle cutter is described in U.S. Pat. Appln. Publ. No. 2003/0056378.

In both Olfa cutting devices, only a single circular cut-out with straight edges can be formed during each use. Often however, it is desired to make multiple circular cuts in a substrate and the Olfa devices are unable to make such cuts in a single use. Rather, the device must be re-sized and used multiple times to make multiple cuts. This is disadvantageous as it wastes time and requires additional effort.

Another issue which arises in the industries mentioned above is that it is often desired to make a decorative cut, i.e., a cut which is not the typical straight line made by standard scissors or an Exacto knife. Scissors are therefore manufactured with a cutting edge which is undulating or wavy to provide such decorative cuts. However, if both a straight cut and decorative cut are desired, it would be necessary to purchase and use two pairs of scissors or purchase a single rotary cutter and two different blades which can be independently mounted thereto and make a blade change between the cuts.

Another concern about cutting devices is the potential for harm when a person inadvertently brushes against an exposed blade while handling the cutting device or mishandles a cutting blade when replacing a blade. For this reason, cutting devices with exposed blades and/or replaceable blades have not been highly welcomed by elderly people who have difficulty in handling the small blades and are reluctant to risk the potential for serious injury caused by the sharp blades.

Yet another concern with hand-held cutting devices is how to cut along parallel lines. Use of a ruler to obtain parallel cuts with a rotary cutting device or a scissor is challenging and often, the lines are not exactly parallel to one another.

With the growing popularity of scrapbooking, quiltmaking, creative crafting, pattern making and collage making, ways are sought to create unique patterns and shapes of sheet material, such as fabric, foil, paper, vinyl and plastic (whether or not these materials are stored prior to use in rolled form or flat, sheet form). Moreover, for framing objects in circular frames, circular mats are usually needed, i.e., an annular piece of material to be inserted into the frame around a picture or other object being displayed in the frame.

It is thus desirable to provide cutting devices which are more versatile than the prior art cutting devices described above and are capable of cutting sheet material in various ways.

It would also be desireable to provide a device which can cut a sheet of material, write on a sheet of material, and emboss a sheet of material, perform any two of the same or different actions on different parts of the sheet of material and even perform any three of the same or different three actions on different parts of the sheet of material. In this manner, a multitude of different variations of cuts, embossed patterns and writings could be made on the same sheet of material. The term "sheet material" of "sheet of material" as used herein is intended to cover all substantially planar substrates, whether sold in flat, sheet form ready for modification or in rolled form which must therefore be unrolled prior to modification.

All of the references mentioned above are incorporated by reference herein.

OBJECTS AND SUMMARY OF THE INVENTION

It is an object of the present invention to provide new and improved cutting devices for cutting planar substrates such as sheet material, including hand-held cutting devices.

It is another object of the present invention to provide new and improved fashioning devices for fashioning or modifying planar substrates such as sheet material, into particular shapes and/or forms and/or to provide them with designs.

It is another object of the present invention to provide new and improved cutting devices for cutting planar substrates which reliably make a plurality of parallel cuts in the substrate during a single use.

It is another object of the present invention to provide new and improved cutting devices for cutting planar substrates and fashioning devices for fashioning or modifying planar substrates which can be used as cutting devices which reliably make a plurality of parallel, concentric cuts in the substrate during a single use.

It is still another object of the present invention to provide new and improved cutting devices which include multiple blades and fashioning devices for fashioning or modifying planar substrates which can be used as cutting devices which include multiple blades, each cutting blade being capable of having a different cutting edge or differently configured cutting construction to enable a plurality of different cuts to be made using a single device. This avoids the need to purchase and use multiple scissors or the need to make a blade change when using a rotary cutter in order to make different cuts.

It is yet another object of the present invention to provide new and improved cutting devices which substantially eliminate the risk of injury caused by exposed blades.

It is another object of the present invention to provide new and improved cutting devices which reduce the risk of injury caused by exposed blades yet enable long-lasting use of the cutting devices.

It is another object of the present invention to provide new and improved fashioning devices for fashioning or modifying planar substrates which are portable.

In order to achieve at least one of these objects and others, a general form of a hand-held cutting device in accordance with the invention includes an elongate body having a handle and at least two rotatable cutting blades mounting on opposite sides of the body. One cutting blade, or two cutting blades when three cutting blades are present, is movable longitudinally relative to the other cutting blade to thereby enable variation in the longitudinal spacing between the cutting blades.

The cutting blades can be arranged to be substantially parallel to one another, i.e., rotate in parallel rotation planes. Also, when two movable cutting blades are provided, they may be arranged in the same rotation plane. Alternatively, the cutting blades can be arranged to rotate in intersecting rotation planes in which case, for each cutting blade which cuts the sheet material at a non-perpendicular angle, i.e., the rotation plane of the cutting blade is at an acute angle to the sheet material, a bevel is formed thereby. Thus, the sheet material is cut on a slant.

The ability to space cutting blades on a common cutting device longitudinally apart from one another enables parallel cuts to be formed which start at different points in a sheet of material. This is useful, for example, when making frames or mats for pictures, or simply for making rectangular shapes for quilts and scrapbooking and the like.

Although the longitudinal spacing of the cutting blades can be accomplished in a variety of different ways, and all of which are intended to be encompassed by the invention, in one non-limiting embodiment, the longitudinal spacing is accomplished by mounting each movable cutting blade on a respective sliding member which slides in a longitudinally extending slot formed on the body. When two movable cutting blades are provided, each mounted on a respective sliding member, the sliding members can be mounted in a common slot or different slots. Each sliding member can be locked in any longitudinal position in the slot, e.g., by tightening a locking screw which passes through the body into engagement with the sliding member to frictionally engage with the sliding member and prevent unintentional movement thereof. Alternatively, a locking screw can pass through the sliding member to frictionally engage with the body.

In addition to or instead of the longitudinal spacing of parallel cutting blades, cutting devices in accordance with the invention can provide transverse spacing of a plurality of cutting blades. That is, one cutting blade is movable transversely relative to the other cutting blade to thereby enable variation in the transverse spacing between the cutting blades, i.e., the cutting width. In one embodiment, the transversely movable cutting blade is not the same as any of the longitudinally movable cutting blades.

To mount the transversely movable cutting blade, the body is formed or provided with one or more projections extending transversely from a side of the body and the cutting device includes a blade mounting member to which the transversely movable cutting blade is mounted. The blade mounting member is movable along and/or securable in connection with the projection(s). One projection may be a substantially cylindrical rod which guides the transverse movement of the blade mounting member, e.g., the guide rod passes through an aperture formed in the blade mounting member. Another projection may be used to position and secure the blade mounting member in any one of a plurality of different transverse positions. To this end, a ridge is formed on the blade mounting member and a plurality of tracks are formed on the positioning projection. The ridge selectively engages with any one of the tracks to enable the blade mounting member to be positioned at a variable transverse distance from the body and thus the cutting blades to be positioned at a variable transverse distance from one another.

Another embodiment of a hand-held cutting device with a plurality of cutting blades is designed to enable each blade to be used independently of the other blades. Since each blade may have a different form of a cutting edge, different cuts can be made using a single cutting device. On the other hand, if all of the blades are the same, when one blade is worn, another cutting blade can then be used until all of the blades are worn. This increases the service life of the cutting device and such an embodiment would be particularly appealing to individuals who are reluctant to handle blades during a replacement procedure, such as the elderly.

Such a cutting device includes a housing having a handle portion and defining a blade-receiving cavity, an actuating mechanism pivotally mounted to the housing and having a handle portion arranged alongside the housing handle portion and a cutting assembly arranged in the cavity and including a plurality of cutting blades. The cutting assembly is rotatable relative to the housing to selectively bring each cutting blade into a cutting position, and has a relaxed position in which the cutting blades are recessed within an outer periphery of the housing, i.e., a cutting edge of the cutting blades is not exposed and thus cannot be used to cut material (in a safety position since injuries are prevented). The cutting assembly is biased into this relaxed position. To use the cutting device, the actuating mechanism handle portion is actuated in a direction toward the housing handle portion to cause the cutting blade in the cutting position to extend beyond the outer periphery of the housing and thereby expose the cutting edge of the cutting blade.

To switch the cutting blade in the cutting position, a handle connected to a disc on which the cutting blades are mounted is turned. A positioning mechanism provides an indication when each cutting blade is in the cutting position, e.g., a biased roller which enters into a notch formed on the disc at a location at which each cutting blade is in the cutting position. The presence of the biased roller in a notch is readily detectable when attempting to turn the handle. Alternatively, instead of a roller, a spring is provided to bias a locking lever or manually actuatable hammer mechanism such that an end thereof enters into each notch.

The actuating mechanism may include an actuating lever pivotally mounted to the housing and including the handle portion, and a biasing mechanism for biasing the actuating lever into a position in which the cutting assembly is in its relaxed position. The actuating lever includes an aperture into which a projection arranged on or integral with the cutting disc passes to thereby enable pivotal movement of the actuating lever to cause movement of the cutting assembly. A side wall of the housing defining the cavity is provided with a slot in which the projection of the cutting assembly is movable to provide for movement of the cutting assembly.

Another embodiment of a cutting device which enables multiple cuts, in particular, multiple circular cuts, includes an elongate rod, a support member including a lower portion having a lower surface adapted to rest on a substrate being cut and an upper portion rotatable relative to the lower portion, the support member being movably mounted on the rod at the upper portion, a plurality of cutting members movably mounted on the rod each having a cutting blade, and a handle movably mounted on the rod. By turning the handle around the support member while applying pressure to the handle and optionally the support member, the cutting blades cut the substrate. The cutting blades may each be a circular rotatable cutting blade having any one of a plurality of different cutting edge patterns or a straight edge knife.

Each cutting member and/or the support member includes a mechanism for fixing a position thereof relative to the rod. In one embodiment, each cutting member and/or the support member includes a channel through which the rod passes and locking knobs each arranged to pass into a respective channel and press the rod against the cutting member.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein:

FIG. 9 is a bottom view of the embodiment shown in FIG. 5;

FIG. 10 is a partial top view of the embodiment shown in FIG. 5;

FIG. 13 is a bottom view of the embodiment shown in FIG. 11;

FIG. 14 is a partial top perspective view of the embodiment shown in FIG. 11;

FIG. 28 is a perspective view of a housing of a first embodiment of a fashioning device in accordance with the invention;

FIG. 29 is a perspective view of the housing shown in FIG. 28 in an open position showing the fashioning device in accordance with the invention;

DETAILED DESCRIPTION OF THE INVENTION

Figure 1:
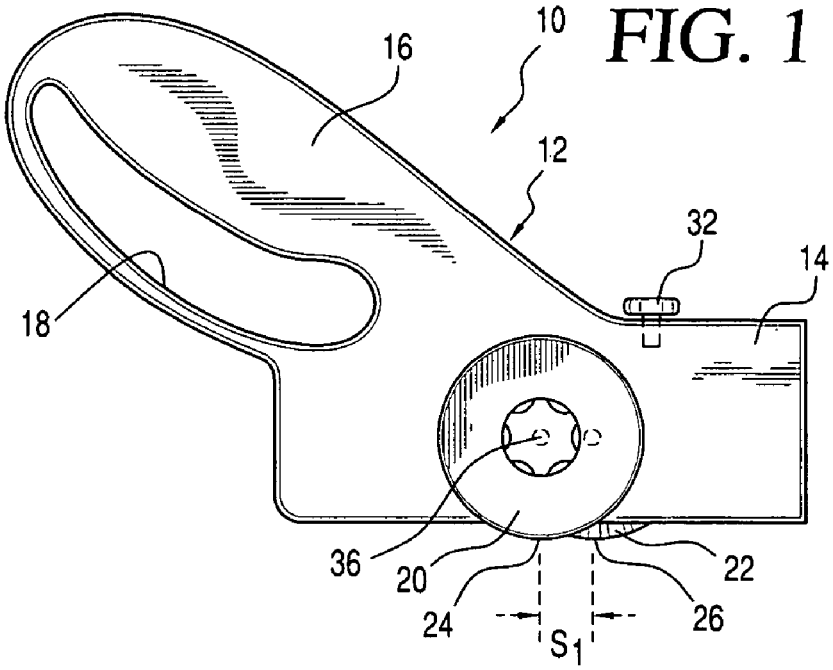
FIG. 1 is a front view of a first embodiment of a cutting device in accordance with the invention.

Referring to the accompanying drawings wherein like reference numbers refer to the same or similar elements, a first embodiment of a cutting device 10 in accordance with the invention is shown in FIGS. 1-4 and generally provides for variable longitudinal spacing between two cutting blades, i.e., the position of one cutting blade in the longitudinal direction of the cutting device is adjustable relative to the position of the other cutting blade.

Cutting device 10 includes an elongate body 12 having a blade-mounting portion 14 and a handle portion 16 extending from the blade-mounting portion 14. Handle portion 16 includes a finger-receiving aperture 18 into which one or more fingers of the user are placed to enable the user to grip the handle portion 16 and effectively use the cutting device 10. Handle portion 16 may be contoured to fit within the palm of the user's hand.

A pair of substantially parallel cutting blades 20, 22 are rotatably mounted on opposite sides of the blade-mounting portion 14 so that a portion of each cutting blade 20, 22 including a cutting edge extends beyond the blade-mounting portion 14. By providing two parallel cutting blades 20, 22, the cutting device 10 can be used to make parallel cuts in a sheet of material when the cutting device 10 is pulled or pushed while in contact with the sheet of material, e.g., when forming a frame or mat for a picture. Preferably, the cutting blades 20, 22 are securely mounted to rotate only in their designated rotation planes, i.e., the cutting blades 20, 22 do not wobble and thus do not adversely affecting the quality of the cuts made thereby. This may be achieved by providing spacer elements between the cutting blades 20, 22 and the body 12 and against which the cutting blades 20, 22 glide.

Instead of arranging the cutting blades 20, 22 to rotate in parallel planes and perpendicular to the sheet material being cut as in the illustrated embodiment, it is also conceivable to arrange one or both of the cutting blades 20, 22 to rotate at an acute angle to the sheet material, e.g., in rotation planes which intersect. In this manner, an angled cut can be formed in the sheet material by one or both cutting blades 20, 22 with the angled cuts still being parallel to one another. This construction would be useful when cutting mats for picture frames which have a discernible thickness and which are often formed with a straight outer cut and an angled inner cut.

Each cutting blade 20, 22 may have a straight cutting edge to produce smooth-edged cuts (cutting blade 20) or a curved or swiggled cutting edge to produce a wavy or undulating-edged cut (cutting blade 22). Both types of cuts can be in one or more straight lines or curved lines depending on how the cutting device 10 is used. Cutting blades capable of producing other edged-cuts can also be used, e.g., a zig-zag cutting edge. Cutting device 10 is preferably designed to accommodate existing cutting blades for rotary cutters such as those made by Fiskars and Olfa Corporation.

The cutting device 10 is capable of longitudinally spacing the cutting blades 20, 22 from one another, i.e., longitudinal spacing the effective cutting points 24, 26 of the cutting blades 20, 22, respectively, from one another. This is useful when it is desired to begin making parallel cuts in a sheet of material with one cut starting at a point before or after the other cut. To this end, the longitudinal position of cutting blade 22 is adjustable while the longitudinal position of cutting blade 20 is fixed. The effective cutting points 24, 26 are at the same longitudinal positions as the centers of the cutting blades 20, 22. The variable longitudinal spacing is represented by reference S1 in FIGS. 1 and 2 and S2 in FIG. 3 which is larger than S1. When the cutting blades 20, 22 are in a state where they are offset or spaced longitudinally from one another, they are referred to as being "out of tandem". Although not shown, the cutting blades 20, 22 can be positioned with their effective cutting points 24, 26 at the same longitudinal point, i.e., in tandem with one another, in which case, the cutting device 10 would be used to make parallel cuts which start at the same point. Also, although not shown, a scale can be provided along the body 12, e.g., along the lower surface thereof, to provide an indication of the longitudinal distance between the cutting blades 20, 22.

Figure 2:
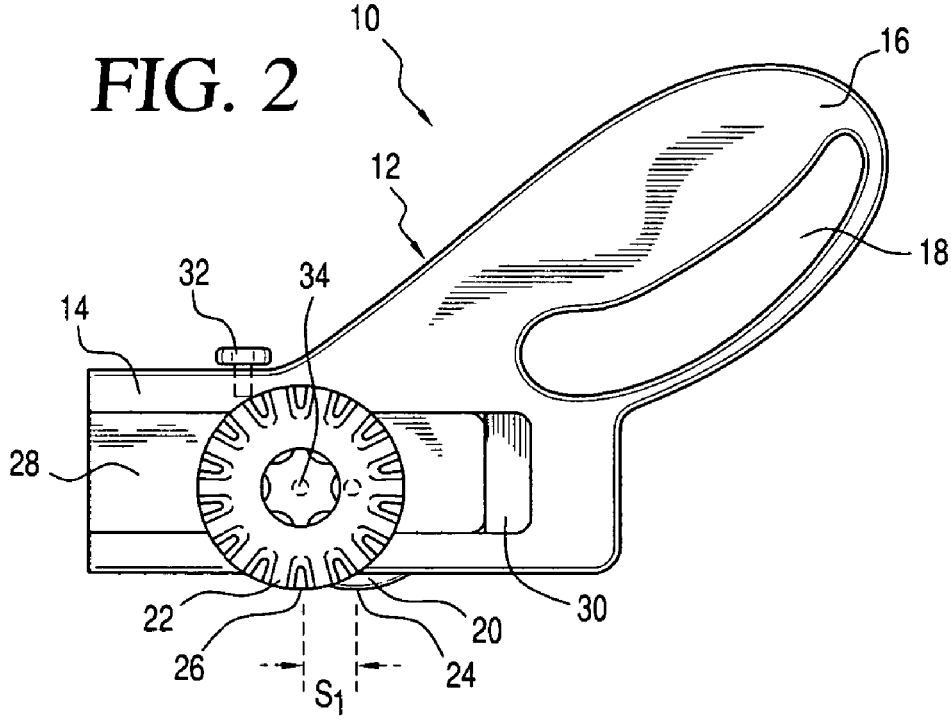
FIG. 2 is a rear view of the embodiment shown in FIG. 1 with one of the cutting blades in a recessed position.
Figure 3:
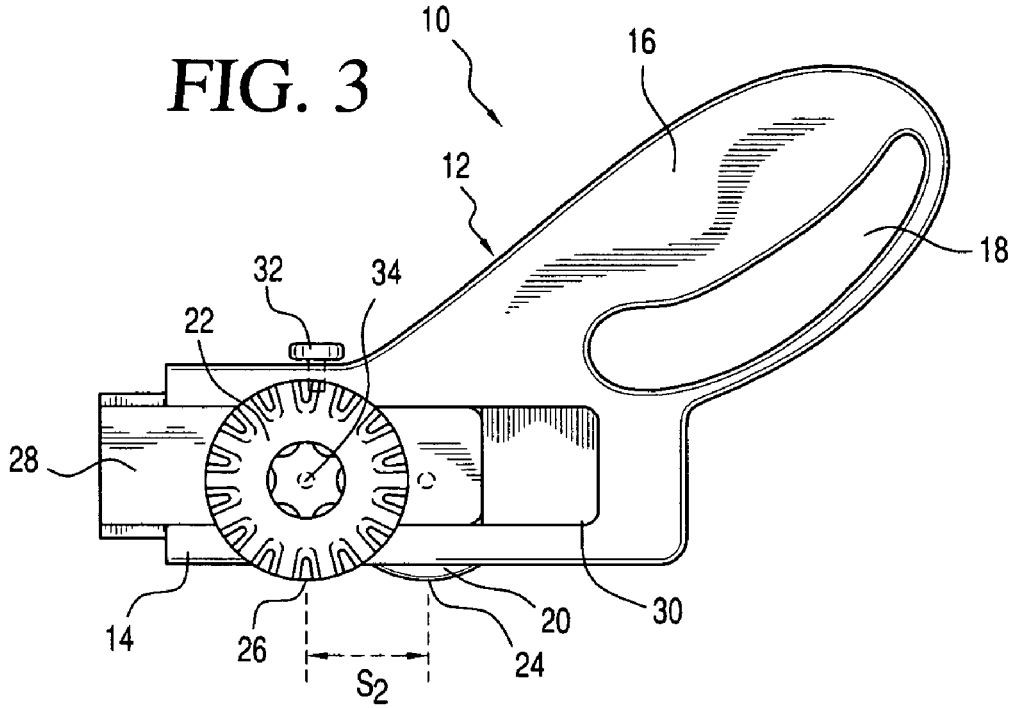
FIG. 3 is a rear view of the embodiment shown in FIG. 1 with the cutting blade in an extended position.
Figure 4:
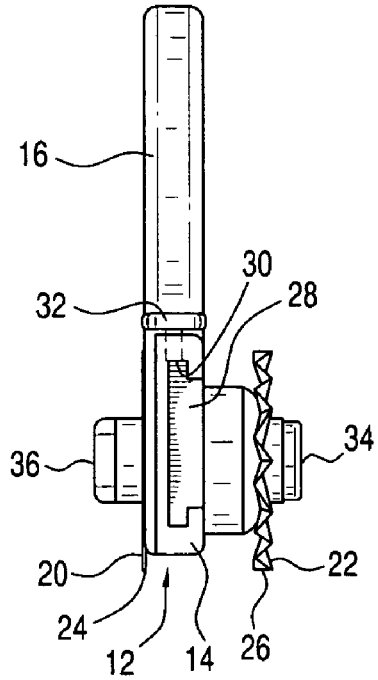
FIG. 4 is a left side view of the embodiment shown in FIG. 1.

Adjustment of the longitudinal position of cutting blade 22 is achieved by mounting cutting blade 22 on a sliding member 28 which slides in a longitudinal slot 30 formed in body 12 (see FIGS. 2-4). Slot 30 may open at either a front end of the blade-mounting portion 14 (as shown) or a rear end of the blade-mounting portion 14 or both. Depending on the mounting location of cutting blade 20, the cutting blade 22 could be movable both forward and rearward relative to the cutting blade 20.

Sliding member 28 is fixed in any one of a plurality of different longitudinal positions on the body 12, thereby also fixing the cutting blade 22 in different longitudinal positions, by tightening a locking screw 32 which engages with the sliding member 28 through the body 12. Other mechanisms for locking the sliding member 28 in different longitudinal positions relative to the body 12 are also envisioned and within the scope and spirit of the invention. For example, a locking screw can pass through the sliding member 28 into engagement with the body 12. In addition to or instead of mounting cutting blade 22 to a sliding member movable relative to the body, cutting blade 20 may be so mounted in order to increase the longitudinal displacement and variability thereof. Thus, in one embodiment, both cutting blades 20, 22 could be longitudinally movable.

A locking knob 34 fixes the cutting blade 22 to the sliding member 28 and another locking knob 36 fixes the cutting blade 20 to the body 12. Locking knobs 34, 36 are preferably provided with a gripping contour which facilitates easy tightening of the cutting blades 20, 22 prior to use of the cutting device 10 and loosening of the cutting blades 20, 22 for removal of the cutting blades 20, 22, e.g., in order to substitute them with other cutting blades.

In use, the user sets the cutting blade 22 to the desired longitudinal position relative to cutting blade 20, i.e., by loosening locking screw 32 and moving the sliding member 28 in the slot 30, and then tightens the locking screw 32 and locking knobs 34, 36. The user then grips the cutting device 10 by inserting his or her fingers through the aperture 18 and presses the cutting blades 20, 22 against the sheet of material being cut, either from an outer edge of the sheet of material or from an interior point in the sheet of material. The cuts can be made freehand or guided by a specially designed rotocutter ruler. Preferably, the sheet of material is placed on a self-healing synthetic pad to prevent damage to an underlying surface, i.e., a table, desk or other work surface. A self-healing synthetic pad is commercially available in different thicknesses.

If the user wants to make only a single cut, then one of the cutting blades 20, 22 may be removed from the cutting device 10 or if only cutting blade 20 is desired, then the sliding member 28 may be entirely removed from engagement with the body 12. If the cutting blades 20, 22 have different cutting edges, then only the cutting blade with the desired cutting edge would remain on the cutting device 10. In this manner, it is possible to provide a cutting device with two different cutting blades and allow either the combined use of both cutting blades to make parallel cuts, or the use of each cutting blade alone without the other cutting blade to make a single cut.

A second embodiment of a cutting device 40 in accordance with the invention is shown in FIGS. 5-10 and generally provides for both variable longitudinal spacing between two cutting blades and variable transverse spacing the two cutting blades, i.e., the position of one cutting blade in a transverse direction of the cutting device is adjustable relative to the position of the other cutting blade. Variable transverse spacing involves the ability to adjust the cutting width defined as the transverse distance between the planes in which the cutting blades 42, 44 rotate. Cutting device 40 thereby enables the formation of strips of material having different widths. The form, orientation and shape of the cutting blades 42, 44 may be as described above with reference to cutting blades 20, 22.

Cutting device 40 includes an elongate body 46 having a blade-mounting portion 48 and a handle portion 50 extending from the blade-mounting portion 48. Handle portion 50 includes a finger-receiving aperture 52 into which one or more fingers of the user are placed to enable the user to grip the handle portion 50 and effectively use the cutting device 40. Handle portion 50 may be contoured to fit within the palm of the user's hand.

Cutting device 40 also includes a positioning projection 54 and a guiding projection 56 extending to one side of the blade-mounting portion 48 of the body 46, and a movable blade mounting member 58 to which cutting blade 44 is mounted. Positioning and guiding projections 54, 56 may be integrally formed with body 46 or separately formed and attached thereto. A plurality of tracks 60 are formed on an inner surface of the positioning projection 54.

Blade mounting member 58 includes an aperture 62 proximate one end which receives the guiding projection 56 so that the blade mounting member 58 slides along the guiding projection 56. A ridge 64 is formed proximate an opposite end of the blade mounting member 58 alongside a depression 66. Ridge 64 is designed to snap securely into each of the tracks 60 to thereby fix the blade mounting member 58 relative to the body 46. Cutting blade 44 is fixed to an inner side of the blade mounting member 58.

Although not shown, a scale may be provided, e.g., engraved, along one or both of the projections 54, 56 to provide an indication of the transverse distance between the cutting blades 42, 44. Adjustment of the transverse position of the cutting blade 44 is achieved by pressing downward on the end 68 of the blade mounting member 58 to cause the ridge 64 to separate from a track 60, sliding the blade mounting member 58 along the guiding projection 56 to another transverse position and snapping the ridge 64 into the track 60 at the new transverse position.

The range of cutting widths capable of being made by the cutting device 40 is limited by the size of the positioning and guiding projections 54, 56 and the construction of the tracks 60 on the positioning projection 54. For example, the positioning and guiding projections 54, 56 may be designed to provide a maximum 3 inch cut and each track may be spaced ⅛ inch apart. The minimum cut is determined by the intervening structure between the cutting blades 42, 44, e.g., the thickness of the blade-mounting portion 48 of the body 46.

Figure 5:
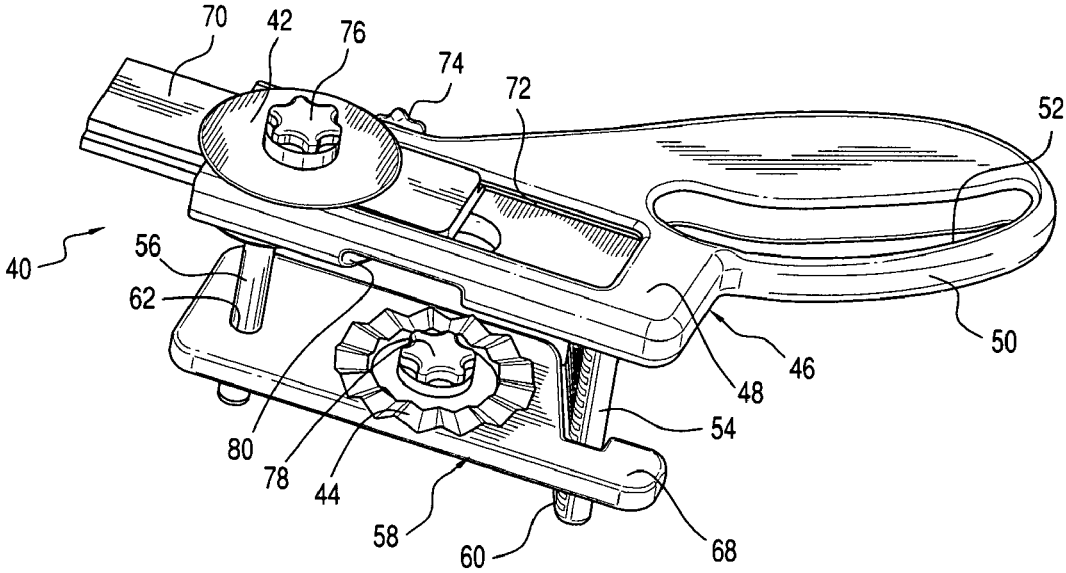
FIG. 5 is a bottom perspective view of a second embodiment of a cutting device in accordance with the invention.
Figure 6:
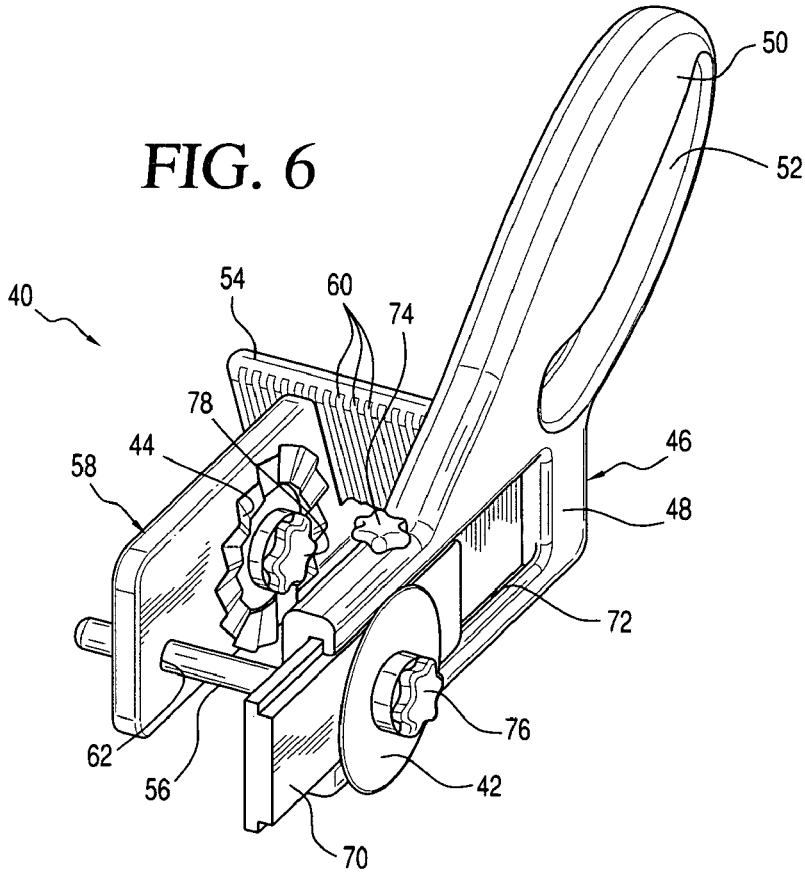
FIG. 6 is a top perspective view of the embodiment shown in FIG. 5.

In addition to variable transverse spacing of the cutting blades 42, 44 relative to one another, cutting device 40 also provides variable longitudinal spacing which is achieved by mounting cutting blade 42 on a sliding member 70 which slides in a longitudinal slot 72 formed in body 46. Slot 72 may open at either a front end of the blade-mounting portion 48 (as shown in FIGS. 5 and 6) or a rear end of the blade-mounting portion 48 or both. Sliding member 70 is fixed in any one of a plurality of different longitudinal positions, thereby also fixing the cutting blade 42 in different longitudinal positions, by tightening a locking screw 74 which frictionally engages with the sliding member 70 through the body 46. Alternatively, the locking screw can pass through the sliding member 70 into frictional engagement with the body 46.

A locking knob 76 fixes the cutting blade 42 to the sliding member 70 and another locking knob 78 fixes the cutting blade 44 to the blade mounting member 58. A cut-out 80 is formed in the blade mounting portion 48 of the body 46 to accommodate and enable access to the locking knob 78 for cases when the blade mounting member 58 is close to the body 46.

In use, the user sets the cutting blade 42 to the desired longitudinal position relative to cutting blade 44, i.e., by loosening locking screw 74 and sliding the sliding member 70 in the slot 72, and then tightens the locking screw 74. The user also determines the desired cutting width and sets the position of the blade mounting member 58 to provide for the desired cutting width in the manner described above. Once the desired longitudinal spacing and transverse spacing between the cutting blades 42, 44 is set, the user grips the cutting device 40 by inserting his or her fingers through the aperture 52 and presses the cutting blades 42, 44 against the sheet of material being cut. As described above, the cuts can be made freehand or guided by a rotocutter ruler and the sheet of material may be placed on a self-healing synthetic pad.

In addition, if it desired to make only a single cut, then the blade mounting member 58 may be removed from engagement with the projections 54, 56 or one of the cutting blades 42, 44 may be removed from the cutting device 40. If the cutting blades 42, 44 have different cutting edges, then only the cutting blade with the desired cutting edge would remain on the cutting device 40. In this manner, it is possible to provide a cutting device with two different cutting blades and allow either the combined use of both cutting blades to make parallel cuts, or the use of each cutting blade alone without the other cutting blade to make a single cut.

Figure 7:
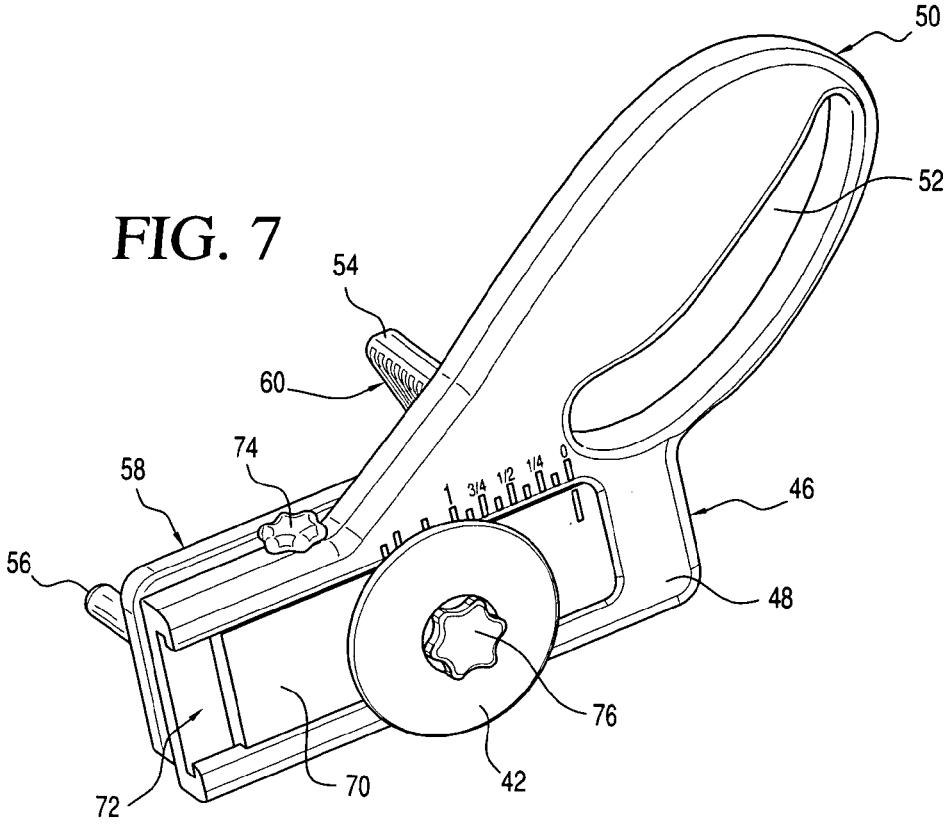
FIG. 7 is a another top perspective view of the embodiment shown in FIG. 5.
Figure 8:
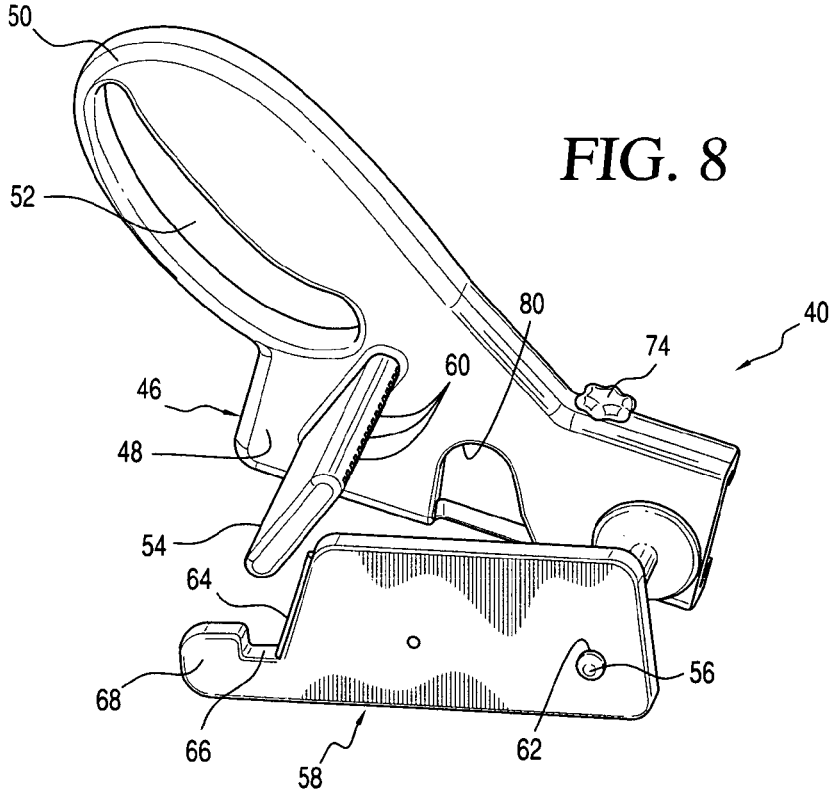
FIG. 8 is a front perspective view of the embodiment shown in FIG. 5 shown during transverse re-positioning of a cutting blade.
Figure 11:
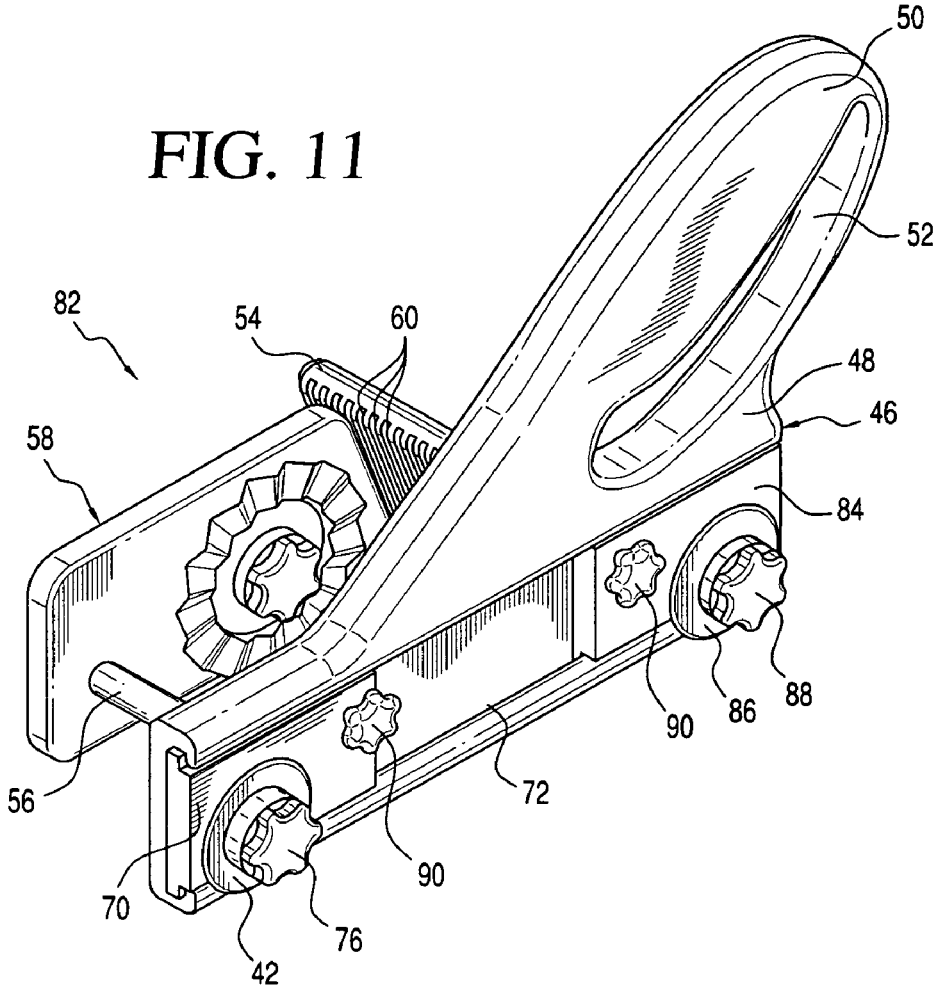
FIG. 11 is a top perspective view of a third embodiment of a cutting device in accordance with the invention.
Figure 12:
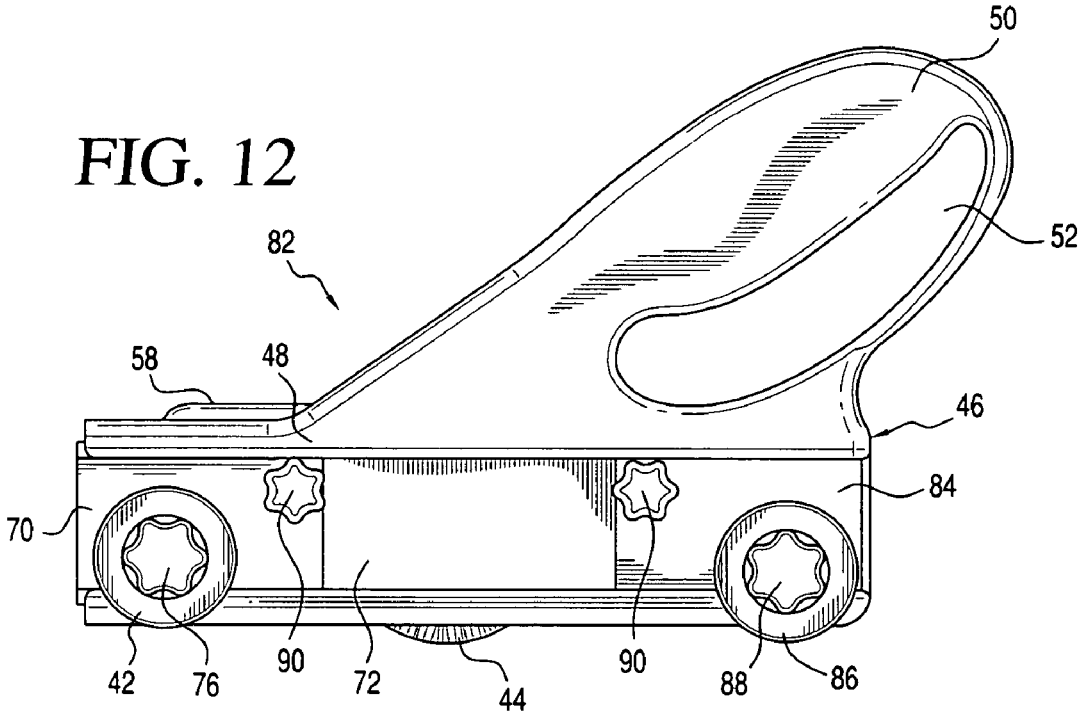
FIG. 12 is a front view of the embodiment shown in FIG. 11.

As shown most clearly in FIG. 7, a scale can be provided on the blade-mounting portion 48 alongside the longitudinal slot 72 which, in combination with a marker on the sliding member 70, allows a user to determine the longitudinal position of the cutting blade 42. As shown in FIG. 10, another scale can be provided on the upper surface of the projection 54 to enable the transverse position of the cutting blade 44 to be determined.

Various modifications of cutting device 40 are possible. For example, instead of having two projections extending from a common side of the body 46 to secure the blade mounting member 58 in a position relative to the body 46, one for attachment (projection 54) and the other for guidance (projection 56), a single projection can be formed which serves both purposes. Moreover, instead of arranging cutting blade 42 on a longitudinally movable sliding member 70, cutting blade 42 could be arranged to be adjustably, transversely spaced from the body 46 by, for example, providing projections 54, 56 and a blade mounting member 58 on each side of the body 46. Although the cutting blades could not be variably longitudinally spaced, the range of cutting widths would be increased (from that of the cutting device 40 as shown) since each cutting blade could be distanced from the body 46 in the transverse direction.

Another modification involves the use of an additional blade mounting member with an associated cutting blade so that two blade mounting members would be engaged with projections 54, 56 and three cutting blades would be transversely spaced apart from one another. Three parallel cuts could therefore be formed. Moreover, if the cutting blades on the blade mounting members are different, then each blade mounting member can be used independently of the other to enable different combinations of cutting blades with a single cutting device.

FIGS. 11-14 show a third embodiment of a cutting device 82 in accordance with the invention which is similar to the one shown in FIGS. 5-10 except that longitudinal slot 72 is extended across the entire body 46, i.e., from one longitudinal end to the opposite longitudinal end, and an additional sliding member 84 is arranged in slot 72. A third cutting blade 86 is mounted on sliding member 84 via locking knob 88 and may be in substantially the same rotation plane as cutting blade 42 and thus also parallel to cutting blade 44. Alternatively, cutting blade 86 may be arranged in a rotation plane which intersects the rotation planes of cutting blade 42 and/or cutting blade 44.

Sliding members 70, 84 can be fixed in slot 72 by locking screws 90 arranged on the sliding members 70, 84 and passing therethrough into frictional contact with the body 46 when the sliding members 70, 84 are fixed in position. Contact between the locking screws 90 and the body 46 prevents movement of the sliding members 70, 84.

Cutting device 82 enables mitre-cutting for forming rectangular and square frames, e.g., to place around pictures.

A scale is provided on the upper surface of the projection 54 to enable the transverse position of the cutting blade 44 to be determined.

The use of cutting device 82 is essentially the same as for cutting device 40 except that the user now has to set the longitudinal position of both cutting blades 42, 86 by loosening the locking screws 90, sliding the sliding members 70, 84 in the slot 72 to the desired positions and then tightening the locking screws 90.

Referring now to FIGS. 15-23D, a fourth embodiment of a cutting device in accordance with the invention is designed to provide a plurality of different cutting blades with cutting edges which are individually and selectively used. Cutting device 100 includes a housing 102 having a handle portion 104 and a cutting portion 106 defining a blade-receiving cavity 108 between substantially planar front and rear parts 106A, 106B, and an actuating mechanism 110 having a handle portion 112 alongside handle portion 104. Front part 106A constitutes a blade guard. Handle portions 104, 112 may be provided with a contour to conform to a person's hand as shown.

Figure 15:
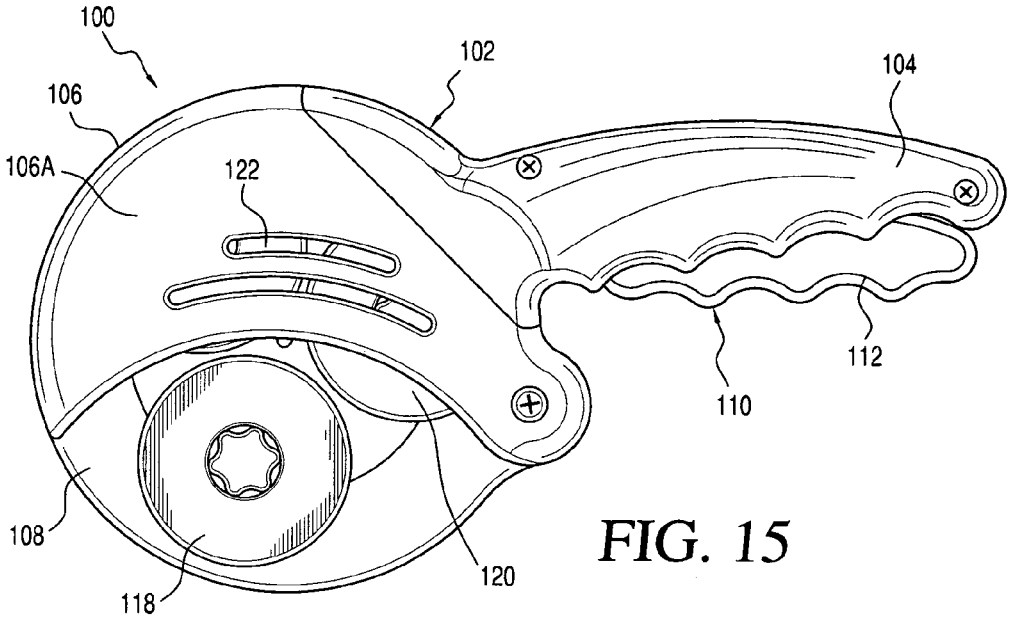
FIG. 15 is a front view of a fourth embodiment of a cutting device in accordance with the invention shown with a cutting assembly in a relaxed position.
Figure 16:
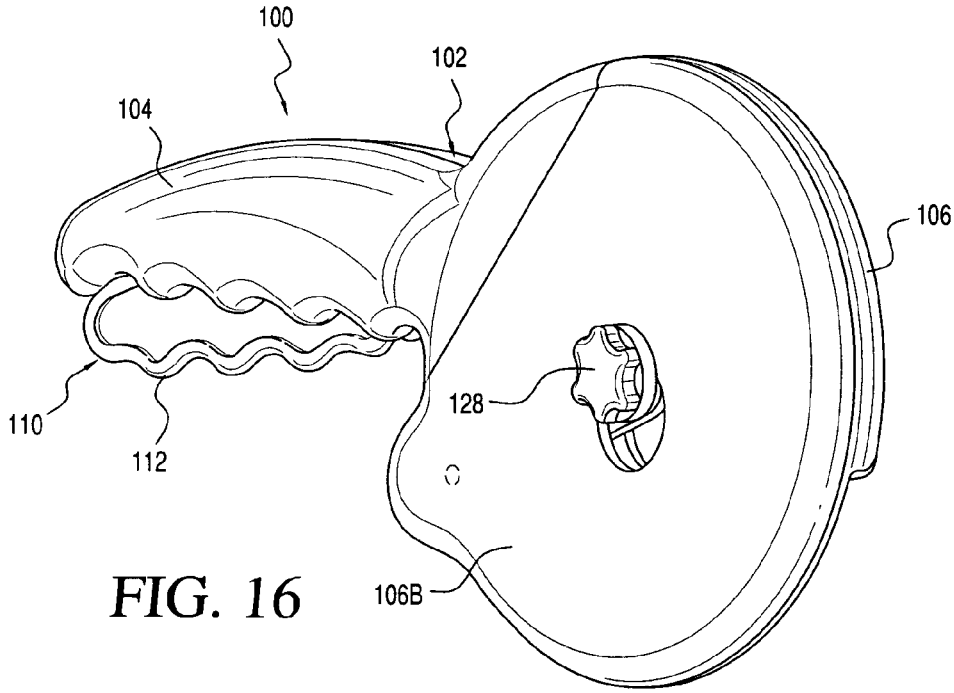
FIG. 16 is a rear perspective view of the embodiment shown in FIG. 15.
Figure 17:
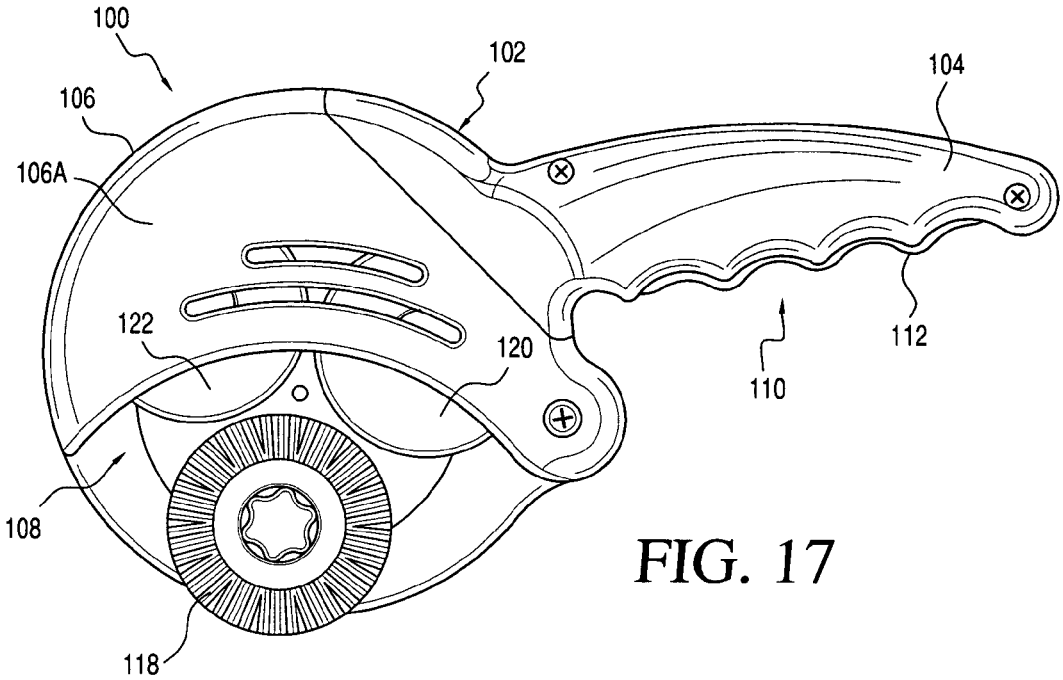
FIG. 17 is a front view of the embodiment shown in FIG. 15 shown with the cutting assembly in a cutting position and with different cutting blades.
Figure 18:
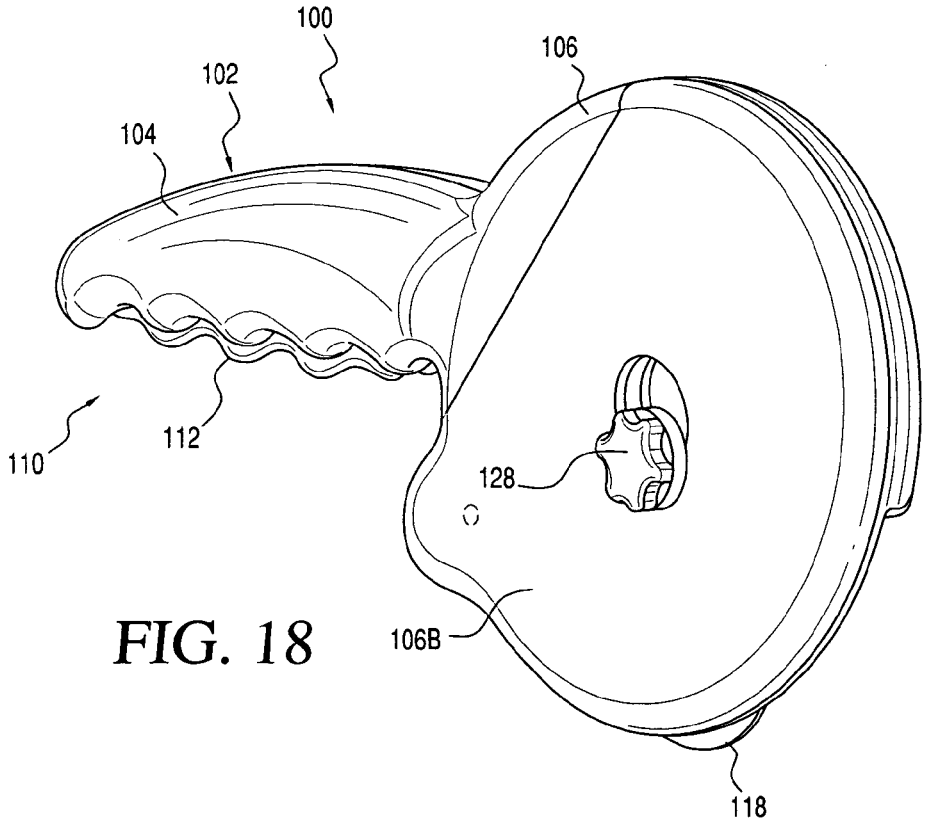
FIG. 18 is a rear perspective view of the embodiment shown in FIG. 15 shown with the cutting assembly in a cutting position and with different cutting blades.

A rotatable cutting assembly 114 is situated in the cavity 108 and includes a disc 116 and three rotatable cutting blades 118, 120, 122 mounted on one side of the disc 116. The form, orientation and shape of the cutting blades 118, 120, 122 may be as described above with reference to cutting blades 20, 22 and locking knobs are also provided to enable replacement of the cutting blades 118, 120, 122. Cutting blades 118, 120, 122 can also have different diameters, e.g., a 28 mm diameter as shown in FIGS. 15 and 16, a 38 mm diameter, and a 45 mm diameter as shown in FIGS. 17 and 18. The selection of which cutting blades to use, vis-a-vis size and cutting edge, is determined by the user prior to each use of the cutting device 100.

In a relaxed position of the cutting assembly 114, the cutting blades 118, 120, 122 are all recessed within the outer periphery of the housing 102 so that none of the cutting edges of the blades 118, 120, 122 are exposed (see FIGS. 15 and 16). This serves a safety and protective feature which avoids injuries.

Figure 19:
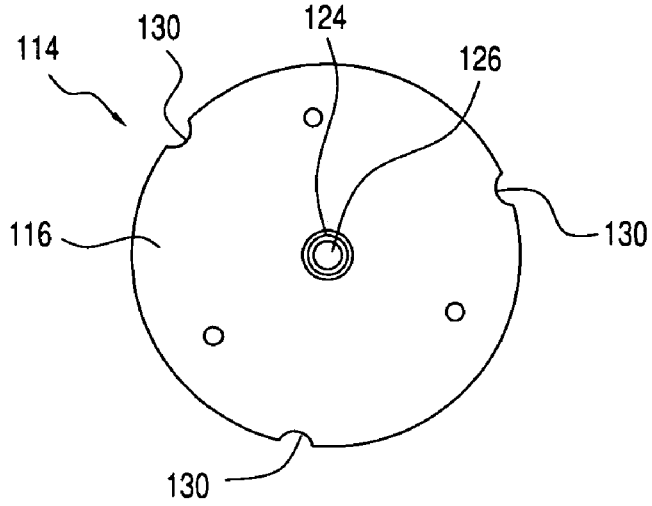
FIG. 19 is a rear view of the cutting assembly.

As shown in FIG. 19, the cutting assembly 114 also includes a substantially cylindrical projection 124 on an opposite side from the blades 118, 120, 122 which may be formed integral with the disc 116. Projection 124 has a smooth outer surface and is designed to pass through an aperture in the actuating mechanism 110 (described below). Cutting assembly 114 also includes a threaded projection 126 extending outward from the projection 124 and a turning dial or knob 128 which is threaded onto the projection 126.

The knob 128 extends outward from the housing 102 (see FIGS. 16 and 18). Knob 128 enables rotation of the disc 116, via projections 124, 126, to selectively bring one of the cutting blades 118, 120, 122 into a cutting position. As shown, cutting blade 118 is in the cutting position while cutting blades 120, 122 are in a storage position.

Figure 20:
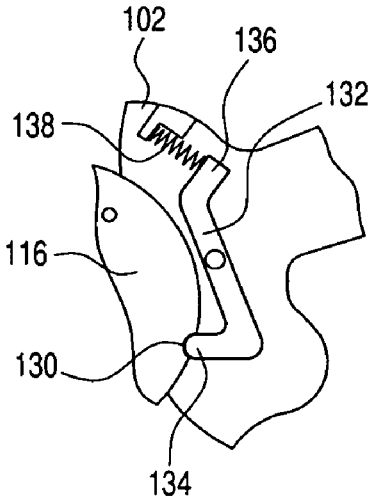
FIG. 20 is a section view of the positioning mechanism for positioning the cutting assembly is predetermined positions.

To position each cutting blade 118, 120, 122 in the cutting position, notches 130 are formed in the outer circumferential surface of the disc 116, one associated with each cutting blade 118, 120, 122, and a biased locking lever or positioning member 132 is pivotally mounted at a middle region to the housing 102 (see FIG. 20). A free end 134 of the positioning member 132 enters into each notch 130 when the associated cutting blade 118, 120, 122 is properly positioned in the cutting position. An opposite end 136 of the positioning member 132 is connected to a spring 138 or other biasing mechanism to continuously bias the free end 134 of the positioning member 132 against the disc 116. Spring 138 is connected at its other end to the housing 102.

In order to change the cutting blade in the cutting position to another cutting blade mounted on disc 116, it is necessary to exert a rotational force to the knob 128 which is sufficient to overcome the biasing force of the spring 138 against the disc 116.

Figure 21:
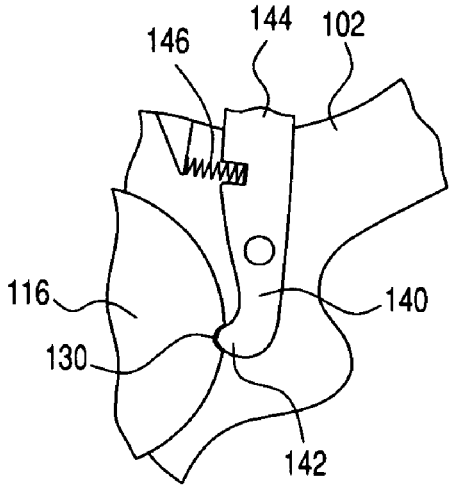
FIG. 21 is a section view of an alternative position mechanism.

Instead of the positioning member 132, a spring-loaded hammer mechanism 140 can be provided which has one end 142 capable of entering into the notches 130 and an opposite end 144 which projects beyond the housing 102 (see FIG. 21). A spring 146 biases the hammer mechanism 140 such that end 142 is biased against the outer surface of the disc 116. When end 144 of the hammer mechanism 140 is pushed forward, against the bias of the spring 146, the end 142 is removed from the notch 130 thereby enabling easy and unencumbered rotation of the disc 116 by turning the knob 128.

Figure 22:
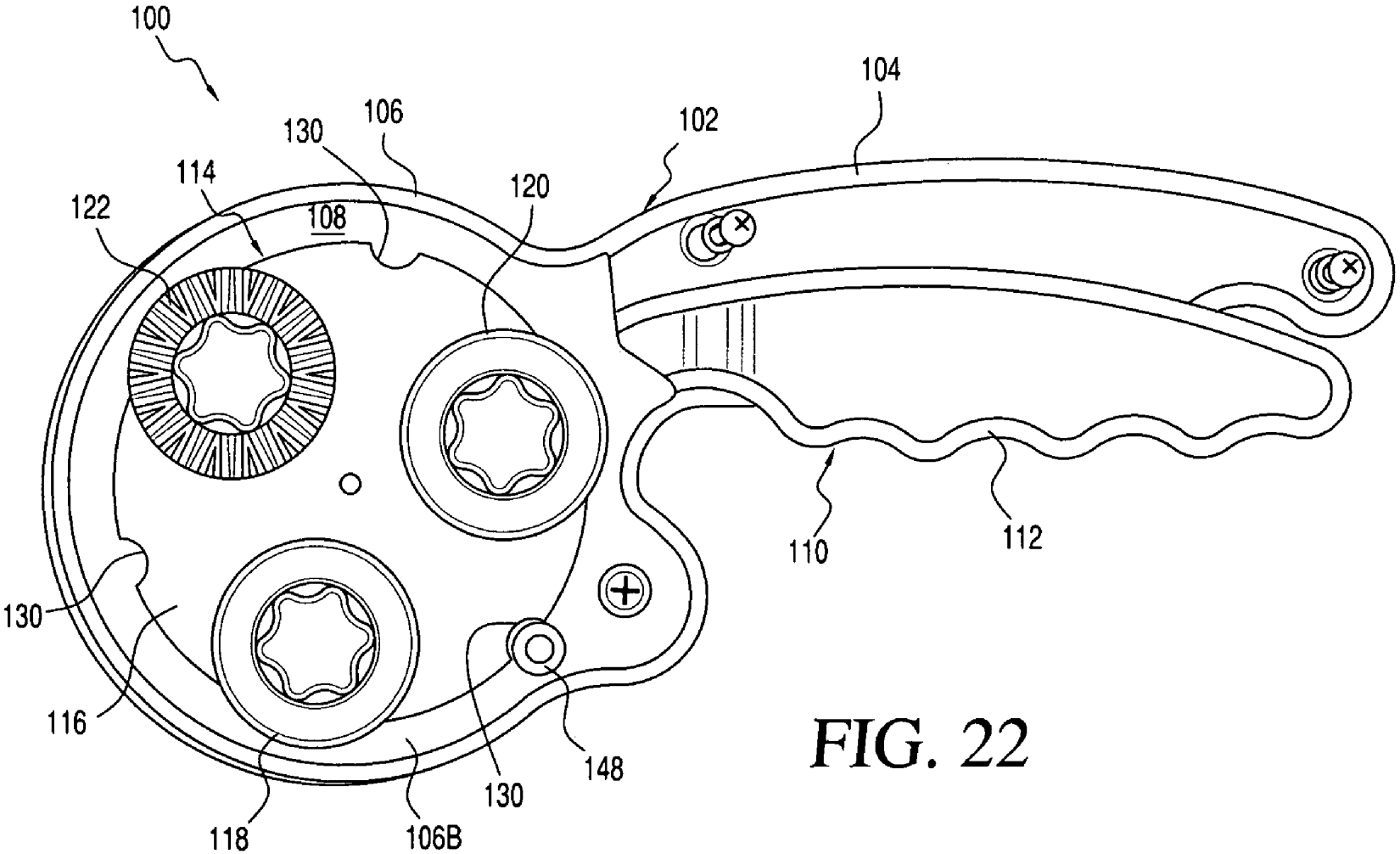
FIG. 22 is a front view of the embodiment shown in FIG. 15 with a cover part removed to expose the cutting assembly and showing another alternative positioning mechanism.

FIG. 22 shows an alternative positioning mechanism which comprises a biased roller 148 movably mounted to the housing 102 and which is biased in a direction toward the disc 116. Roller 148 exerts a force against the disc 116 and enters into the notches 130 when the cutting assembly 114 is positioned with one of the cutting blades 118, 120, 122 in the proper cutting position.

Referring now to FIGS. 23A-23D, actuating mechanism 110 includes a lever 150 pivotably mounted to the housing 102 to pivot about a pivot axis 152, with one end of the lever 150 including handle portion 112. Lever 150 is situated substantially between the disc 116 and the rear part 106B of the housing 102. An aperture 154 is formed at an opposite end region 156 of the lever 150 and may be surrounded by a reinforcement ring 158. Projection 124 of the cutting assembly 114 is arranged in aperture 154 so that it can rotate therein and thus enable the cutting assembly 114 to rotate relative to the lever 150.

Actuating lever 150 is pivotable about pivot axis 152 between a first position in which the cutting blade 118 in the cutting position is recessed within the outer periphery of the housing 102 and incapable of cutting (as shown in FIGS. 15 and 16) and a second position in which the cutting blade 118 in the cutting position extends beyond the housing 102 and the cutting device is capable of cutting a substrate (as shown in FIGS. 17 and 18). In the first position, the handle portion 112 is distant from handle portion 104 while in the second position, handle portion 112 is proximate handle portion 104.

Figure 23A:
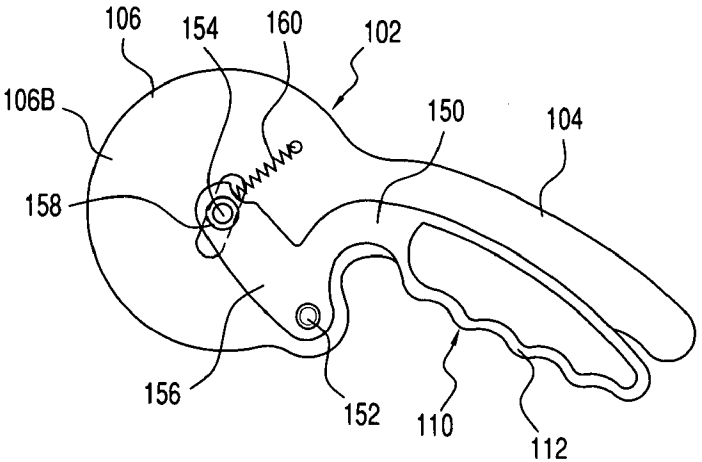
FIGS. 23A, 23B, 23C and 23D are front views of the embodiment shown in FIG. 15 with the cutting assembly removed to expose various actuating mechanisms.
Figure 23B:
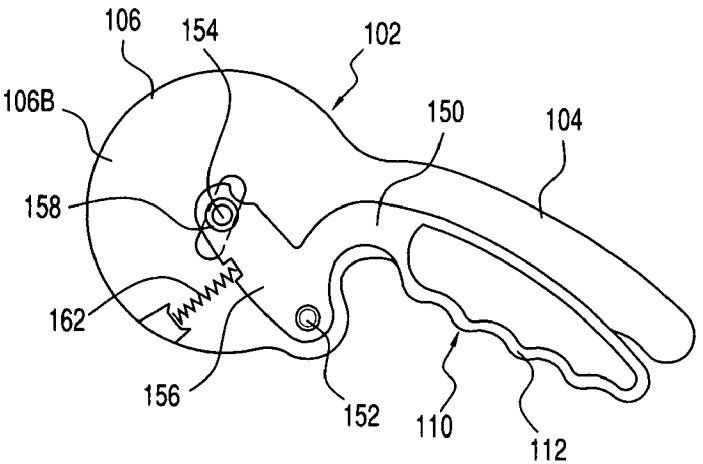
Figure 23C:
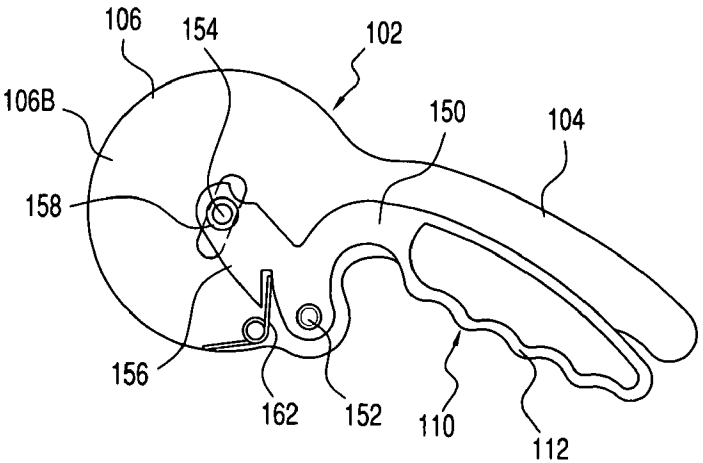

Handle portion 112 is biased into the first position by either a compression spring 160 exerting a upward force against the lever 150 (FIG. 23A) or a tension spring 162 exerting an downward force against the lever (FIGS. 23B and 23C). At one end, springs 160, 162 are connected to or engage with the lever 150 and at the other end, are connected to the housing 102. Springs 160, 162 are thus effective to return the actuating lever 150 to the first position when the gripping force applied to handle portion 112 is removed.

Figure 23D:
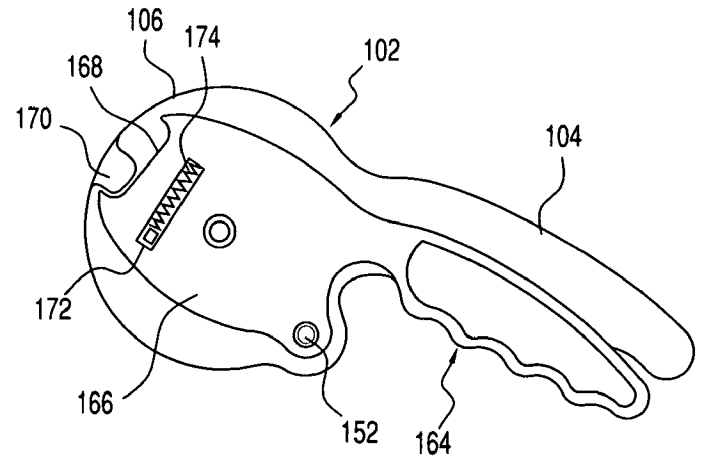

FIG. 23D shows an alternative actuating mechanism 164 including a broad forward portion 166 having a recess 168 at a forward end which cooperates with a projection 170 formed on the housing to limit the pivotal movement of the forward portion 166. A slot 172 is formed in the forward portion 166 and a compression spring 174 is arranged in the slot with one end engaging the forward portion 166 and the other end connected to the housing 102.

To enable cutting with cutting blade 118, it is necessary to extend the cutting edge beyond the outer periphery of the housing 102 and this is achieved by gripping the handle portions 104, 112 causing actuating lever 150 to pivot about pivot axis 152. The end region 156 of the lever 150 is therefore urged in a downward direction, along with the disc 116 and cutting blade 118 mounted thereon, by virtue of the positioning of projection 124 in the aperture 154 of the lever 150.

To enable the cutting assembly 114 to move upon pivoting of the lever 150, a slot 176 is formed in the rear part 106B of the housing 102 and the projection 124 moves in this slot 176.

Through appropriate design of the cutting assembly 114, care is taken to ensure that the positioning member 132 remains in the notch 130 during the movement of the cutting assembly 114 caused by movement of actuating mechanism 110. This also applies to the alternative positioning mechanisms shown in FIGS. 21 and 22.

An advantage of the cutting device 100 is that the operative cutting blade can easily be switched for another, different cutting blade. In a preferred embodiment, it is envisioned that each cutting blade 118, 120, 122 has a different cutting edge. Thus, when the user wants to use the cutting blade 118 with its distinctive cutting edge, he would turn the knob 128 until cutting blade 118 is situated in the cutting position. Then, when it is desired to use the cutting edge provided by cutting blade 120, the user would again turn the knob 128 until cutting blade 120 is situated in the cutting position. When it is desired to use the cutting edge provided by cutting blade 122, the user would again turn the knob 128 until cutting blade 122 is situated in the cutting position. The cutting blade switching process could be repeated to selectively use each of the cutting blades 118, 120, 122 as desired by the user.

Although cutting device 100 is shown with three blades, any plural number of cutting blades can be provided on the disc 116.

In use, assuming cutting with cutting blade 118 is desired, handle portion 112 is urged toward handle portion 104 causing the actuating lever 150 to pivot about pivot axis 152 and thus downward movement of the disc 116 and cutting blade 118 mounted thereon into a position with its cutting edge exposed beyond the outer periphery of the housing 102. The positioning member 132 is maintained in engagement with the notch 130 associated with cutting blade 118. The cutting device 100 is then pushed or pulled over a substrate to cut it. So long as the handle portion 112 is held against handle portion 104, the user can cut the substrate since the cutting edge of cutting blade 118 is exposed.

Once the cutting is finished, the user releases his grip on handle portion 112 and the spring 160, 162 causes actuating lever 150 to return to its first position and the disc 116 to be moved upward into the housing 102. The cutting assembly 114 is thus returned to its relaxed position.

If cutting with cutting blade 120 or 122 is desired, the user turns the knob 128 with sufficient force to cause the free end 134 of the positioning member 132 to move out of the notch 130 and along the disc 116. Turning of knob 128 continues until the desired cutting blade is in the cutting position. The actual cutting with the desired cutting blade proceeds s described above.

Figure 24:
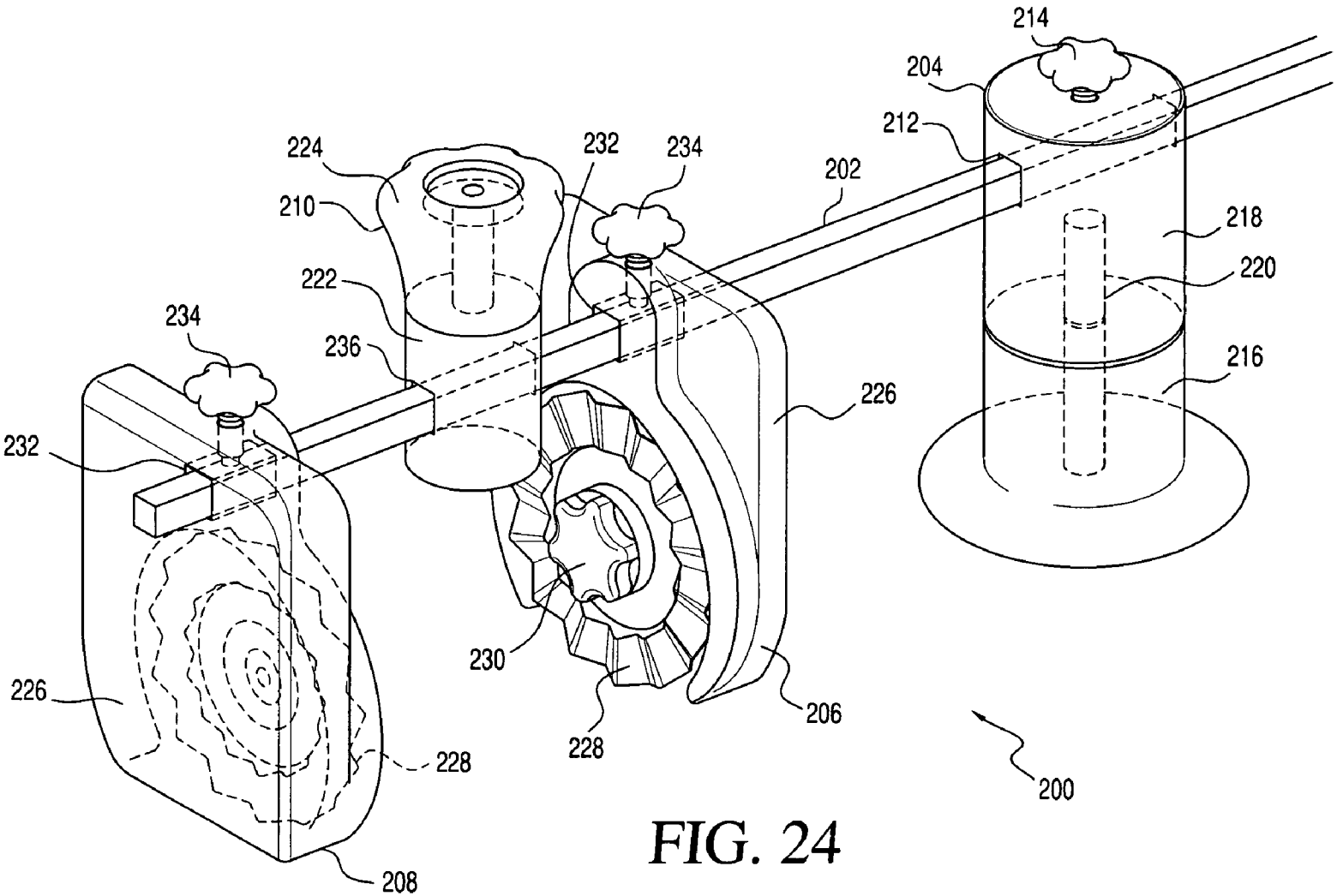
FIG. 24 is a perspective view of a fourth embodiment of a cutting device in accordance with the invention.
Figure 25:
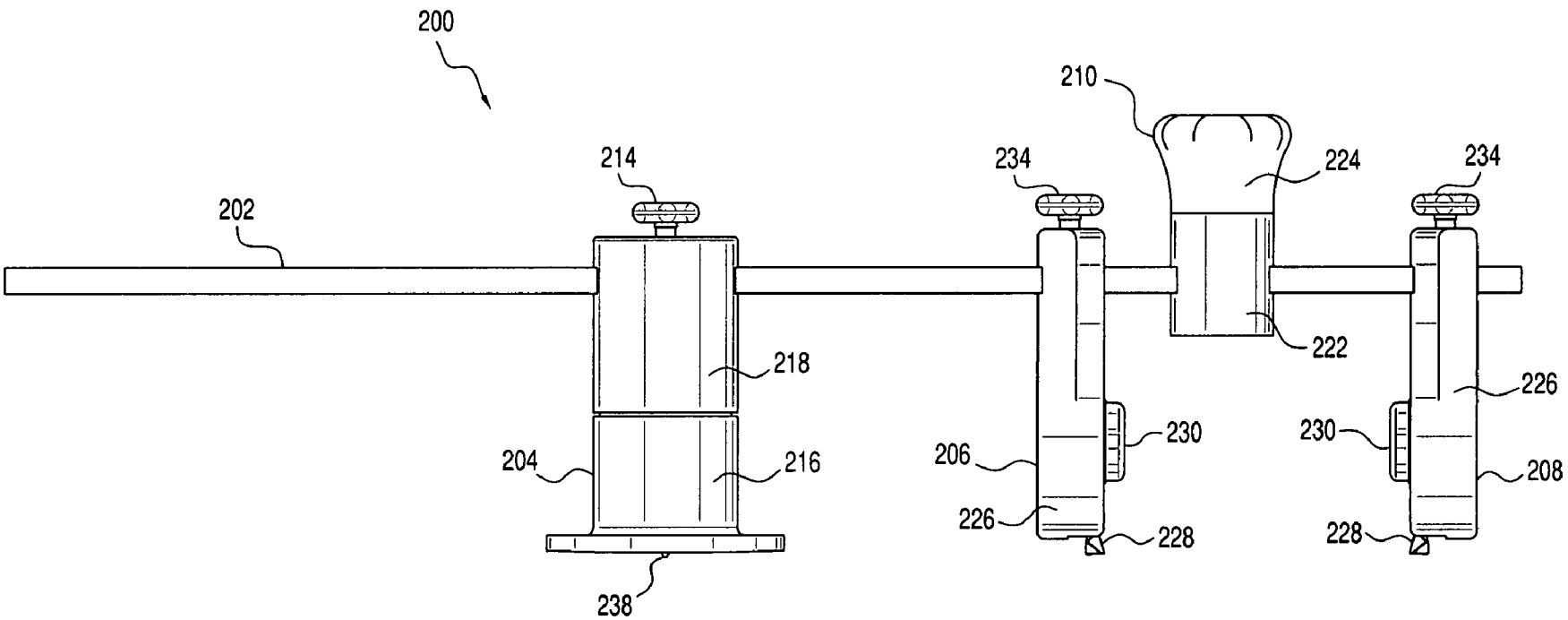
FIG. 25 is a rear elevational view of the cutting device shown in FIG. 24.

FIGS. 24 and 25 show another embodiment of a cutting device 200 in accordance with the invention. Cutting device 200 is designed generally to enable circular, concentric cuts to be made in sheet material to obtain an annular section of the sheet of material. For example, cutting device 200 may be used to make an annular mat for placement in a circular picture frame. Cutting device 200 differs from the cutting devices described above in that it is not a hand-held unit.

Cutting device 200 includes an elongate rod 202 along which several members 204, 206, 208, 210 are mounted for movement in a longitudinal direction of the rod 202. A first member 204 is a positioning and support member having a channel 212 through which the rod 202 passes and a threaded locking knob 214 projecting from an upper surface. Locking knob 214 is screwed into a threaded aperture in the support member 204 which extends from the upper surface to the channel 212 so that by turning the locking knob 214 in one direction, it engages the rod 202 and presses it against the bottom surface defining the channel 212 to thereby fix the support member 204 relative to the rod 202. Turning the locking knob 214 in the opposite direction releases the fixing of the support member 204 relative to the rod 202 and enables the rod 202 to slide in the channel 212. Movement of the rod 202 in the channel 212, when the cutting members 206, 208 are fixed to the rod 202, enables the radial positions of the cutting members 206, 208 to be varied.

Support member 204 is substantially cylindrical and includes a flared lower base portion 216 to enable the cutting device 200 to easily rest on the sheet of material or other substrate being cut. A needle point 238 projects downward from the lower portion 216 to engage with the substrate being cut and facilitate retention of the cutting device 200 in position on the substrate. Optionally, the flared bottom portion 216 may be a suction cup, which would be particularly useful if the material being cut is one to which suction force can be applied. Other forms and shapes of the support member 204 are also possible.

Support member 204 includes an upper portion 218 rotatable relative to the lower portion 216. To this end, a rotation cylinder 220 is arranged in aligned central cavities in the upper and lower portions 216, 218, respectively. Other mechanisms for arranging the upper portion 218 to rotate relative to the lower portion 216 are also within the scope and spirit of the invention.

Members 206, 208 are cutting members, each of which includes a body 226 and a rotatable cutting blade 228 removably attached to the body 226 by a locking knob 230. Cutting blades 228 extend beyond the lower surface of the cutting members 206, 208. The form, orientation and shape of the cutting blades 228 may be as described above with reference to cutting blades 20, 22. Thus, different cutting blades can be provided on the cutting members 206, 208 or the same cutting blades can be provided.

In one embodiment, the cutting blades 228 are arranged to be perpendicular to the sheet material to form straight cuts in the sheet material. Alternatively, it is possible to arrange the cutting blades 228 at an angle to the sheet material to form an angled cut in the sheet material. This construction would be useful when cutting mats for picture frames which have a discernible thickness and which are often formed with a straight outer cut and an angled inner cut.

Instead of circular, rotatable cutting blades 228, fixed cutting blades can be provided, similar to Exacto blades. Such fixed blades may be oriented either perpendicular or at an acute angle, e.g., 45°, to the sheet material.

Cutting members 206, 208 each have a channel 232 through which the rod 202 passes and a threaded locking knob 234 projecting from an upper surface. Each locking knob 234 is screwed into a threaded aperture in the respective cutting member 206, 208 which extends from the upper surface to the channel 232 so that by turning the locking knob 234 in one direction, it engages the rod 202 and presses it against the bottom surface defining the channel 232 to thereby fix the cutting member 206, 208 relative to the rod 202. Turning the locking knob 234 in the opposite direction releases the fixing of the cutting member 206, 208 relative to the rod 202 and enables the cutting members 206, 208 to slide along the rod 202 to different radial positions relative to the support member 204, when the support member 204 is fixed in position.

Member 210 is a handle having a channel 236 in a lower portion 222 through which the rod 202 passes. An upper portion 224 of the handle 210 may be rotatable relative to the lower portion 222 or fixed thereto. As shown, handle 210 is arranged between cutting members 206, 208 but may also be arranged inward of both cutting members 206, 208, i.e., between the inner cutting member 206 and the support member 204, or outward of both cutting members 206, 208, i.e., between the outward cutting member 208 and the end of the rod 202. Handle 210 is freely slidable along the rod 202, although a similar locking knob can be provided as for support member 204 and cutting members 206, 208.

The cross-sectional shape of the rod 202 may be designed to prevent rotation of some or all of the members 204, 206, 208, 210 about an axis defined by the rod 202, e.g., rectangular or square as shown.

To use cutting device 200 to make circular, concentric cuts, the support member 204 is placed in the center of the sheet of material being cut, the locking knobs 214, 230, 234 are loosened and the cutting members 206, 208 are positioned such that the cutting blades 228 are at the desired radial position of the cuts to be made. Such positioning may involve sliding the rod 202 through the channel 212 in the support member 204 and/or sliding one or both cutting members 206, 208 along the rod 202. Once the cutting blades 228 are at the desired radial positions, the locking knobs 214, 230, 234 are all tightened, while ensuring that the radial positions of the cutting blades 228 do not change. The handle 210 is then grasped and while applying pressure to the support member 204, and preferably the handle 210 as well, the handle 210 is rotated around the support member 204 causing the cutting blades 228 to cut the sheet material, i.e., to form a pair of concentric circles in the sheet material.

Although cutting device 200 is shown with two cutting members 206, 208, a different amount of cutting members can be provided. If only one cutting member is provided, a single circle section of material is obtained while if three cutting members are provided, three circular cuts are made thereby forming two rings.

Cutting device 200 can include numerous cutting members with each cutting member including a cutting blade which forms a different cut, e.g., a straight cut, a wavy cut, a zig-zag cut, etc., so that any combination of cuts, or any individual cut, can be formed simply by sliding the cutting member(s) having the cutting blade(s) which provide the desired cut(s) onto the rod 202.

Figure 27:
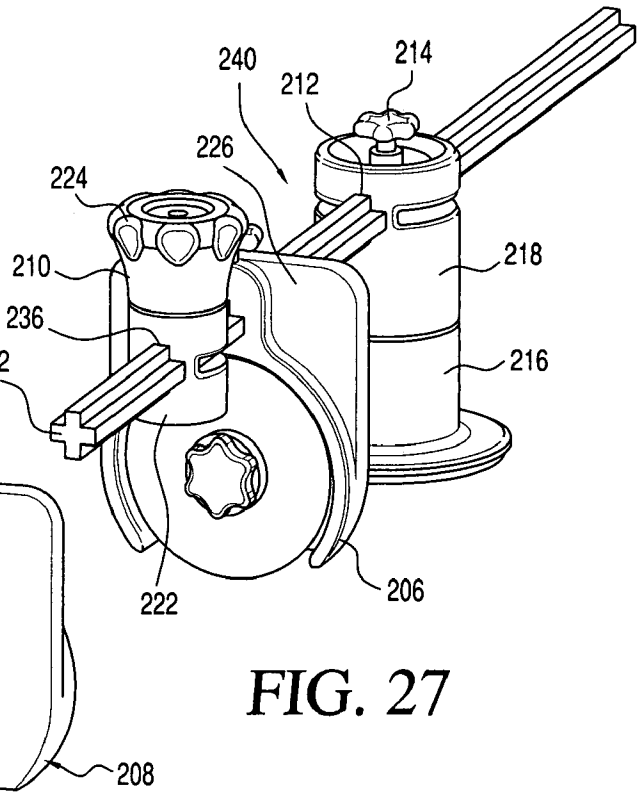
FIG. 27 is a perspective view of the cutting device shown in FIG. 26 with only a single cutting implement.
Figure 26:
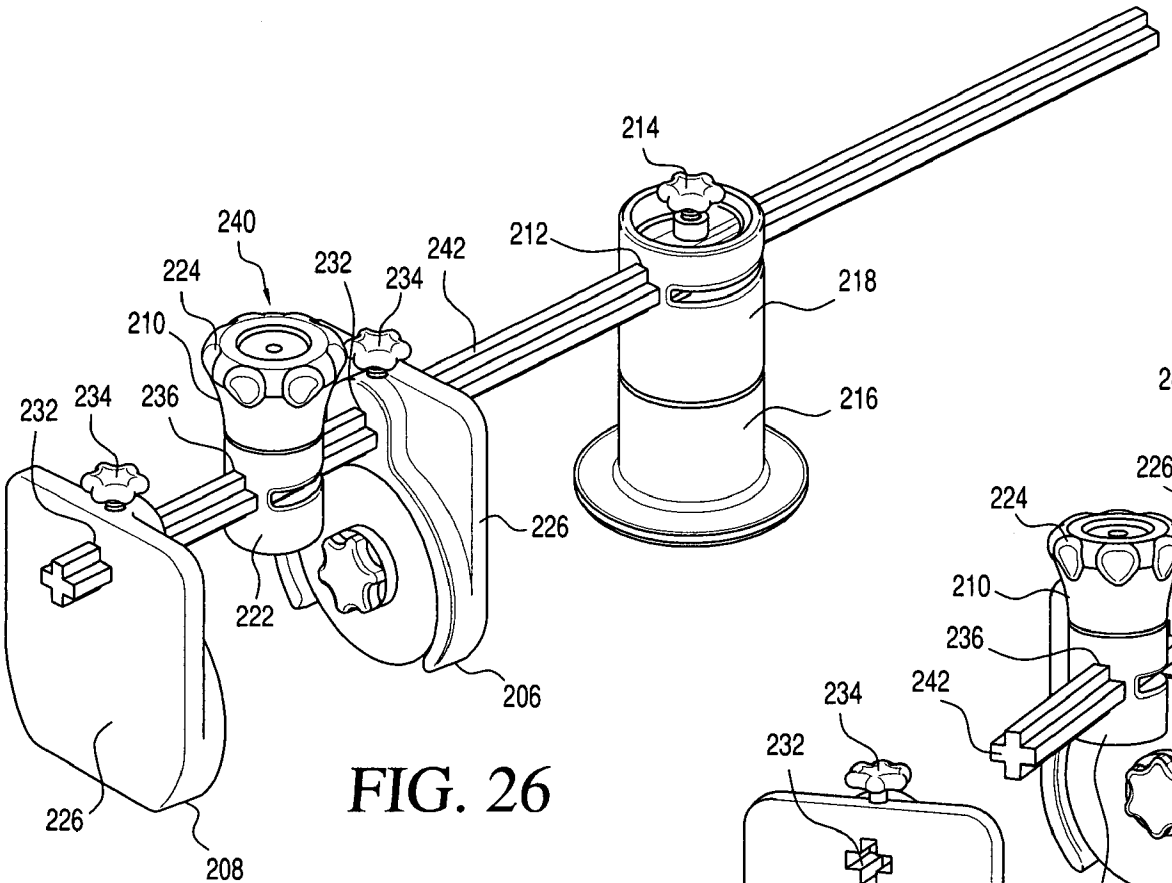
FIG. 26 is a perspective view of a fourth embodiment of a cutting device in accordance with the invention.

FIGS. 26 and 27 show a cutting device 240 in accordance with the invention which is similar to cutting device 200 with the significant difference that it includes a rod 242 having a cross-shaped cross-section. To this end, channels 212, 232 and 236 have a corresponding cross-sectional shape. Cutting device 240 can be used with both cutting members 206, 208 as shown in FIG. 26 to make a pair of concentric cuts (to thereby obtain a most likely desired annular piece of material and a probably undesirable circular piece of material) or with only a single cutting member 206 as shown in FIG. 27 to make a single circular cut (to thereby obtain a desired circular piece of material).

In the embodiments of the cutting devices described above, protective or safety features to cover the blades are often not shown. However, such safety and protective features are within the scope and spirit of the invention and may entail blade sheaths or blade covers as known to those skilled in the art.

Referring now to FIGS. 28-32, a first embodiment of a fashioning device in accordance with the invention is portable and integrated with a housing 310 including a base 312 having a handle 314, and a cover 316 hingedly connected to the base 312 on a side opposite the handle 314. Base 312 includes a latching member 318 which is designed to pass over a projection 320 formed on the cover 316 to thereby secure the housing 310 in a closed position as shown in FIG. 28. Alternatively, the cover 316 may include a handle and/or latching member and the base 312 may therefore include a cooperating projection to the latching member on the cover. Other arrangements for enabling a releasable locking or latching of the base 312 and cover 316 together are also possible.

Housing 310 defines an interior designed to snugly accommodate a fashioning device 322 while enabling use thereof (see FIG. 28). The shape and size of the housing 310 may vary depending on the shape and size of the fashioning device 322.

A battery compartment may be built into the housing 10 to house batteries which are needed to provide electricity to a motor or other electronic actuation mechanism which powers the fashioning device 322. An access door 324 to the battery compartment can be formed to open either to the inside of the housing 310 or to its exterior (see FIG. 28). Also, compartments could be formed in the housing 310, opening either to its interior or exterior, to accommodate sheet materials to be fashioned by the fashioning device, for example, circular sheets of paper or fabric to be cut or embossed by the fashioning device 322. Additionally or alternatively, retaining members such as a net, pouch or pocket, could be formed on the inner surface of the base 312 and/or cover 316 to receive such sheet materials.

Further, compartments could be formed in the housing 310, opening either to its interior or exterior, to accommodate a variety of different fashioning heads for use in fashioning device 322, e.g., cutting heads, embossing heads and scribing heads. Additionally or alternatively, mounting brackets for securely mounting or retaining the fashioning heads during movement of the housing 310 could be formed on the inner surfaces of the base 312 and/or cover 316.

Fashioning device 322 includes mounting brackets 326A, 326B arranged on the base 312 in diametrically opposite positions, a substantially circular turntable 328 rotatably mounted to the base 312 between the mounting brackets 326A, 326B, and an actuating arm 330 pivotally mounted to mounting bracket 326A and selectively engageable with mounting bracket 326B. To rotate the turntable, the fashioning device 322 includes a power unit 332 mounted to the base 312. Alternatively, the power unit 332 can be removed and the turntable manually rotated. A manually operated version (not shown) functions in a similar manner as well.

Mounting bracket 326A includes a pair of opposed sides and a pivot pin 334 which extends through aligned apertures in the sides. The actuating arm 330 is attached to the pivot pin 334. Mounting bracket 326B includes a pair of opposed sides and a spring-like catch 336 therebetween. Catch 336 is resiliently mounted to the base 312 and has a hook-shaped upper end designed so that when the actuating arm 330 is pivoted against the catch 336 to bring the actuating arm 330 into an operative position, it engages an inclined surface of the hook-shaped upper end and urges the catch 336 outward. After the actuating arm 330 passes completely over the inclined surface, the catch 336 moves inward over a part of the actuating arm 330 thereby securing the actuating arm 330 to the mounting bracket 326B and preventing its movement out of engagement therewith. When it is desired to lift the actuating arm 330 out of engagement with the mounting bracket 326B, the catch 336 is flexed outward and the actuating arm 330 is then free to be pivoted upward.

Turntable 328 includes a gear ring 338 on its underside. Gear ring 338 may be formed integral with the turntable 328 or separate therefrom and then attached thereto. To rotatably mount the turntable 328 to the base 312, a projection can be formed in the center of the base 312 and an aperture formed in the gear ring 338, turntable 328, or a support member thereon into which the projection on the base 312 enters. Alternatively, the base 312 can be provided with an aperture or a support member with an aperture and a downward projection formed on the underside of and in the center of the turntable 328 which enters into the aperture formed on the support member or the base. Other ways to rotatably mount the turntable 328 to the base 312 are also envisioned within the scope and spirit of the invention.

Turntable 328 is preferably made of a sturdy material capable of withstanding repeated pressing by a cutting blade or knife or writing or embossing instrument. To this end, it can be made of a self-healing material or can be made of a rigid material and coated with a self-healing material. The self-healing property enables the surface to close after absorbing cuts from cutting blades and the like. The upper surface of the turntable 328 can be marked with dimensional markings and possibly provided with a grid-like appearance.

Actuating arm 330 includes an elongate frame 340 having mounting flanges 342 at one end which are attached to the pivot pin 334, and a latching section 344 at an opposite end which engages with the catch 336. Actuating arm 330 also includes a guide rod 346 extending between mounting flanges 348, 350 formed on the frame 340 and through an intermediate mounting flange 352 formed on the frame 340. A first fashioning head 354 is slidably mounted on guide rod 346 between mounting flanges 348, 352 and a second fashioning head 356 is slidably mounted on guide rod 346 between mounting flanges 350, 352. A worm gear 358 is rotatably mounted at its ends to mounting flange 348 and a mounting member 360 arranged on the latching section 344 (see FIG. 28). A friction ring or roller 62 is arranged on the worm gear 358 to rotate along with the worm gear 358 (see FIGS. 29 and 30). Frame 340 includes a slotted wall 364 with a plurality of slots spaced apart from one another and a slot 366 alongside the wall 364 and through which an operative part of the fashioning head 354 extends (see FIG. 30). Although both fashioning heads 354, 356 are mounted to the same guide rod 346, it is possible to mount each on its own separate guide rod.

Fashioning heads 354, 356 may each include any type of instrument which causes a change in the shape, form or design of a substrate being worked on, i.e., a substrate placed on the turntable 328. Examples of fashioning heads 354, 356 include cutting heads which would include a cutting instrument such as a blade or knife, embossing heads which would include pattern forming instruments such a blunt-headed instruments and scribing heads which would include pencils, pens, markers and the like.

Each fashioning head 354, 356 is designed to operate in a different manner. Fashioning head 354 is designed to move along the worm gear 358 as the turntable 328 rotates so that a spiral is formed by whatever instrument is arranged thereon. Fashioning head 356 is designed to stay in a fixed position on the frame 340 so that as the turntable 328 rotates, a circle is formed by whatever instrument is arranged in connection therewith.

Fashioning head 354 includes an instrument holder 368 which holds a cutting, embossing or scribing instrument 370 which is designed to contact the sheet material present on the turntable 328, and a mounting section 372 connected to the instrument holder 368. Mounting section 372 has a pair of flanges 374 with apertures through which the guide rod 346 passes such that the fashioning head 354 is pivotable about the guide rod 346 into an operative position in which the instrument 370 is in contact with the sheet material on the turntable 328 (see FIG. 29) and a non-operative position in which the instrument 370 is separated from the sheet material on the turntable 328 (see FIG. 32).

For use as a cutting head, the implement 370 may be a swivel knife which swivels to continuously place its cutting surface in the direction in which the knife is moving. Thus, as the fashioning head 354 moves and the turntable 328 rotates, the knife is moving commensurately to ensure that its cutting surface acts on the substrate placed on the turntable 328 to cleanly cut it. The knife also passes through the substrate into the self-healing material thereof which then "heals" to remove any trace of the cut caused by the knife.

The frame 340 is constructed so that the fashioning head 354 is positionable with the instrument 370 at an approximate centerpoint of the turntable 328. This allows a spiral cut or line to start from or terminate at the center of a sheet of material placed onto the turntable 328. Indeed, the centerpoint of the turntable 328 may be marked and aligned with the instrument 370 when the fashioning head 354 is positioned at its innermost position.

Mounting section 372 also includes one or more curvilinear or arcuate surfaces 376 which engage with the worm gear 358 when the fashioning head 354 is in its operative position (see FIGS. 31 and 32) so that rotation of the worm gear 358 translates into sliding movement of the fashioning head 354 along the guide rod 346. As the fashioning head 354 slides along the guide rod 346 and the turntable 328 rotates, the instrument 370 moves relative to the turntable 328 and a spiral cut or line is thereby formed. Conventional mechanisms for converting or translating rotation of a worm gear into linear movement of a member engaging therewith (i.e., the fashioning head 354 herein) and vice versa can also be used in the invention.

Figure 30:
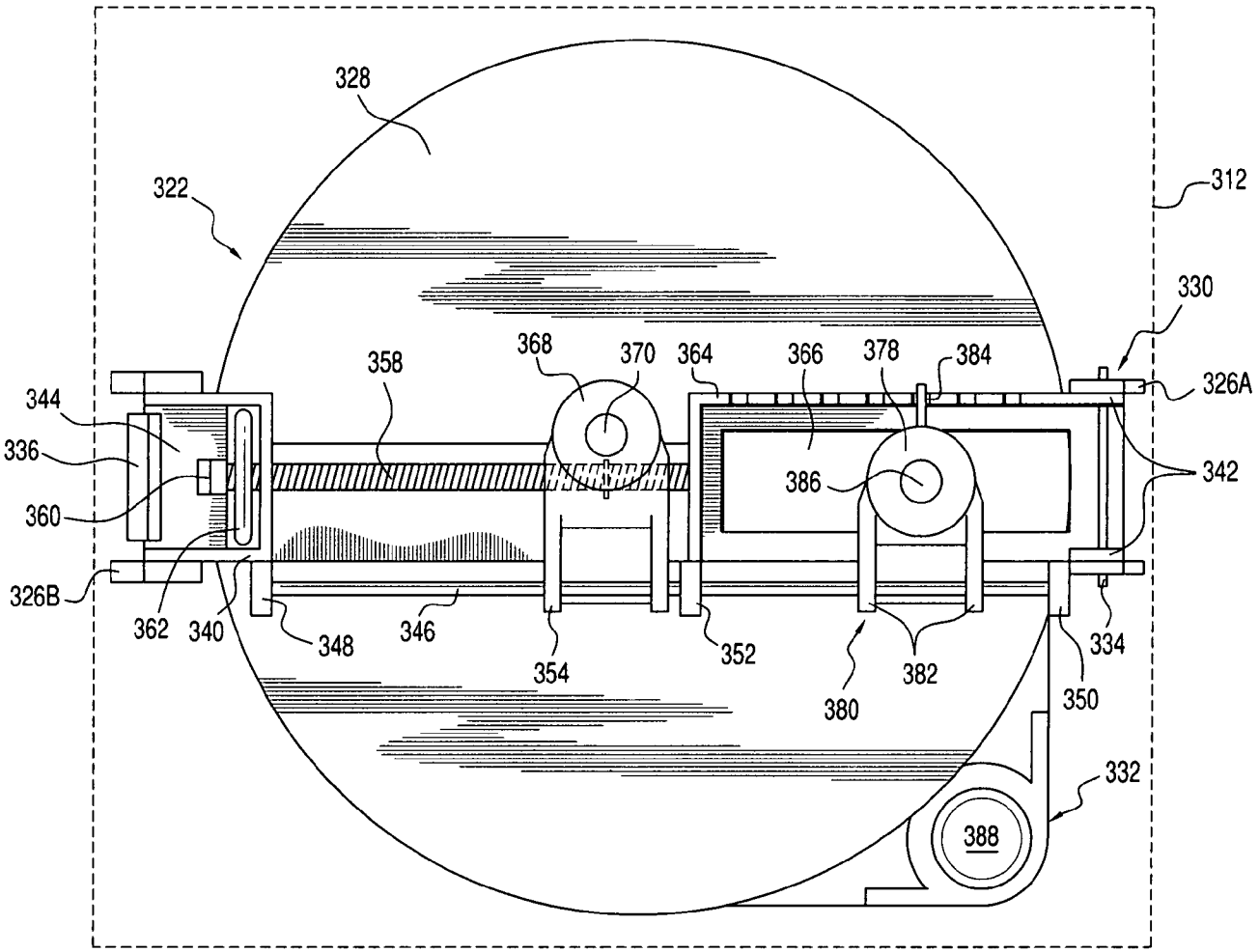
FIG. 30 is a top view of the fashioning device shown in FIG. 28.
Figure 31:
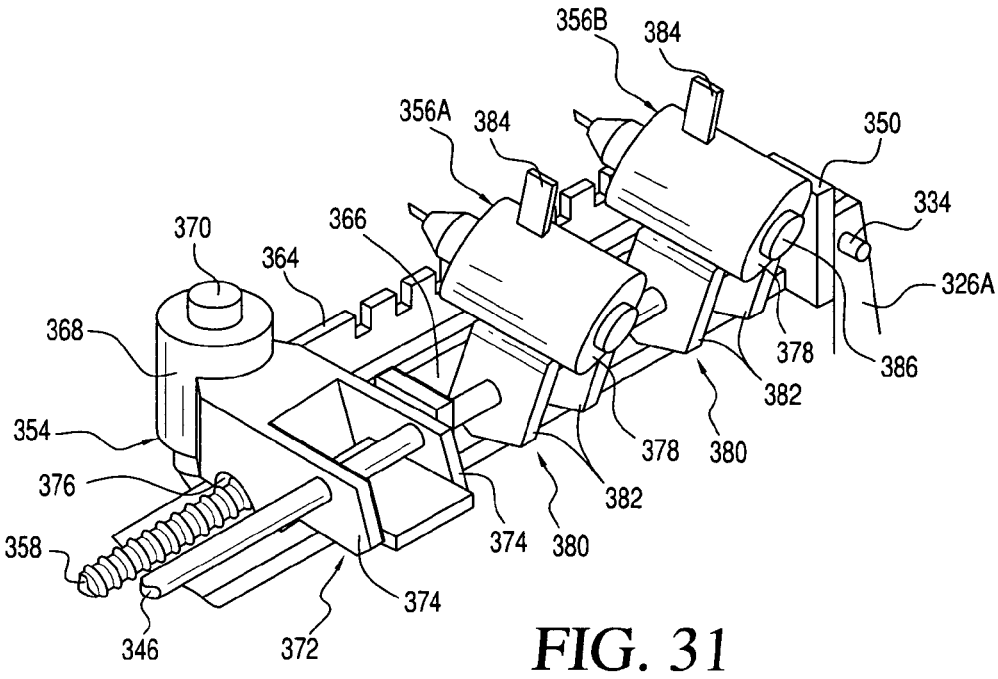
FIG. 31 is a partial view of an alternative actuating arm for the fashioning device shown in FIG. 28.

Worm gear 358 may be removably attached to the frame 340 to enable different worm gears to be used, each worm gear having a different pitch. Worm gears with different pitches will provide spirals having different pitches. A fine pitch, such as shown in FIGS. 29 and 30, will provide a narrow spiral while a coarse pitch of the worm gear, such as shown in FIG. 31, will provide a broad spiral. Alternatively, a worm gear can be constructed with both a narrow spiral and a broad spiral and whichever type of spiral is desired would be used, e.g., by re-positioning the fashioning head 354 along the desired spiral.

Figure 32:
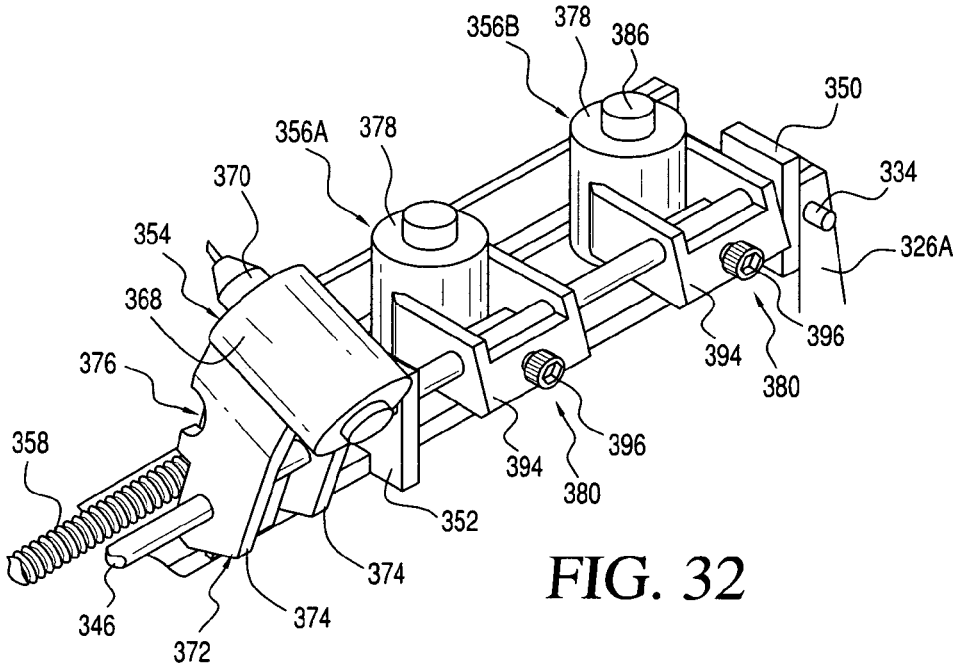
FIG. 32 is a partial view of another alternative actuating arm for the fashioning device shown in FIG. 28.

In the non-operative position of fashioning head 354, the arcuate surfaces 376 are out of contact with the worm gear 358 (see FIG. 32). This allows the fashioning head 354 to be moved axially along the guide rod 346, and thus enables the starting point of the spiral cut or line to be freely selected. Lubrication can be provided to facilitate the sliding of the fashioning head 354 along the worm gear 358.

Instrument holder 368 can be constructed such that the instrument 370 can be freely insertable into and movable from a slot formed therein. Alternatively, instrument holder 368 can be constructed such that instrument 70 may be retained therein using any conventional type of securing device, for example, arranging an adjustment screw to pass through the instrument holder 368 into a slot therein and into engagement with one side of the instrument 370 to press the instrument 370 against an opposite side of the slot.

Fashioning head 356 includes an instrument holder 378 which holds a cutting, embossing or scribing instrument 386 which is designed to contact the sheet material present on the turntable 328, and a mounting section 380 connected to the instrument holder 378. Mounting section 380 has a pair of flanges 382 with apertures through which the guide rod 346 passes such that the fashioning head 356 is pivotable about the guide rod 346 into an operative position in which the instrument 386 is in contact with the sheet material on the turntable 328 (see FIGS. 29 and 32) and a non-operative position in which the instrument 386 is separated from the sheet material on the turntable 28 (see FIG. 31).

Fashioning head 356 is slidable axially along the guide rod 346 when in the non-operative position and can then be placed into a plurality of different operative positions, each defined when a tab 384 extending from the instrument holder 378 is situated in one of the slots on wall 364. This enables the fashioning head 356 to be positioned in different radial positions relative to the turntable 328 to thereby cause the instrument 386 arranged thereon to form a circular cut or line in a sheet of material on the turntable 328 having different diameters upon rotation of the turntable 328 relative to the instrument.

Instrument holder 378 can be constructed such that the instrument 386 can be freely insertable into and movable from a slot formed therein. Alternatively, instrument holder 378 can be constructed such that instrument 386 may be retained therein using any conventional type of securing device, for example, arranging an adjustment screw to pass through the instrument holder 378 into a slot therein and into engagement with one side of the instrument 386 to press the instrument 386 against an opposite side of the slot.

Power unit 332 includes a motor 388 mounted to the base 312, a gear 390 engaging with the gear ring 338 and a switch 392 which causes rotation of the gear 390 (see FIGS. 28 and 29). Switch 392 is arranged on an outer wall of the base 312. In view of the engagement between gear 390 and gear ring 338, when motor 388 is actuated causing rotation of gear 390, turntable 328 is rotated. Electrical connections between the motor 388, switch 392 and batteries housed in the battery compartment described above are also provided in a manner known to those skilled in the art. Alternative rotation mechanisms for rotating the gear 390 or for causing rotation of the turntable 328 with or without gear 390 and gear ring 338 are also envisioned to be within the scope and spirit of the invention. For example, a cord can be housed in a compartment formed in the housing 310 and electrically connected to the motor 388 so that when the cord is removed from the housing 310 and plug into an outlet, electricity is thereby provided to the motor 388.

Power unit 332 can be arranged to provide both clockwise and counterclockwise rotation of the turntable 328, e.g., by providing switch 392 as a three-way switch. In this manner, the fashioning head 354 can be positioned anywhere along the worm gear 358 and either an inward spiral or an outward spiral formed depending on the direction of rotation of the turntable 328. Thus, a spiral extending inward from the outer edge of the sheet of material can be formed as well as a spiral extending outward from the center of a sheet of material. Moreover, the start and end of the spiral can be freely selected by appropriate positioning of the fashioning head 354 along the worm gear 358 to provide intermediate spiral cuts or lines in the sheet of material.

Turntable 328 is supported during its rotation by roller 362. Additionally, rotation of the turntable 328 can be stabilized by arranging one or more friction rings or rollers on the base 312 below the turntable 328 and against which the turntable 328 rests. The rollers above and below the turntable 328 aid in maintaining the turntable 328 substantially flat and prevent it from wobbling. By maintaining the turntable 328 flat, better cuts or lines are provided by fashioning device 322.

Fashioning device 322 can be used to change the shape and/or form of sheet material depending on the instruments 370, 386 used in the fashioning heads 354, 356, the number of fashioning heads as well as which fashioning heads are used.

In the embodiment shown in FIGS. 29 and 30, it is possible to form a spiral cut or line in sheet material on the turntable 328 using only fashioning head 354 (in which case fashioning head 356 is pivoted upward so that its instrument does not contact the sheet material on the turntable 328). It is also possible to form a circular cut or line in sheet material on the turntable 328 using only fashioning head 356 (in which case, fashioning head 354 is pivoted upward so that the arcuate surfaces 376 do not engage the worm gear 358). It is also possible to form both a spiral cut or line and a circular cut or line using both fashioning heads 354, 356 (in the condition shown in FIGS. 29 and 30).

FIGS. 31 and 32 show part of alternative actuating arms 330A, 330B each of which includes two fashioning heads 356A, 356B slidably mounted on guide rod 346 between mounting flanges 348, 350, each similar in construction to fashioning head 356 described above. In this embodiment, it is possible to form a spiral cut or line in sheet material on the turntable 328 using only fashioning head 354 (in which case fashioning heads 356A and 356B are pivoted upward so that their instruments do not contact the sheet material on the turntable 328). It is also possible to form a single circular cut or line in sheet material on the turntable 328 using either fashioning head 356A or 356B (in which case, the other fashioning head 356A or 356B and fashioning head 354 are pivoted upward so that their instruments do not contact the sheet material). It is also possible to form a spiral cut or line and a pair of circular cuts or lines using fashioning heads 354, 356A and 356B (in the condition shown in FIG. 31). It is also possible to form a pair of circular cuts or lines in sheet material on the turntable 328 using both fashioning heads 356A and 356B (in which case, fashioning head 354 is pivoted upward so that the arcuate surfaces 376 do not engage the worm gear 358) (this condition being shown in FIG. 32). It is also possible to form both a spiral cut or line and a circular cut or line using fashioning head 354 and one of fashioning heads 356A or 356B (in which case the other fashioning head 356A or 356B is pivoted upward so that its instrument does not contact the sheet material).

FIG. 32 also shows a variation in the manner in which the fashioning heads 356A and 356B are fixed in position. Instead of providing a slotted wall 364 on frame 340 and tabs 384 on the instrument holders 378, the mounting section 380 includes a transverse section 394 having an aperture and a locking screw 96 is threaded into the aperture and can pass through the aperture to press against the guide rod 346. The fashioning heads 356A, 356B are movable along guide rod 346 by loosening the locking screw 396, displacing the fashioning heads 356A, 356B and then tightening the locking screws 396 with the fashioning heads 356A, 356B at the desired locations.

In an exemplifying but non-limiting use of fashioning device 322 shown in FIGS. 29 and 30, the housing 310 is first opened and the actuating arm 330 is released from engagement with the mounting bracket 326B by pressing the catch 336 outward to release latching section 344, and the actuating arm 330 is then pivoted upward. A piece of sheet material is placed onto the turntable 328 and the actuating arm 330 is pivoted downward until the latching section 344 snaps under catch 336.

The fashioning head or heads 354, 356 to be used are determined and an instrument placed in each. Any fashioning head not being used may be pivoted to its non-operative position, but if it does not include an instrument, such pivoting is unnecessary. If fashioning head 354 is being used, it is pivoted upward and moved along the guide rod 346 until a desired end position of the instrument 370 is reached. This position may be gleaned by holding the instrument 370 slightly above the sheet of material. The fashioning head 354 is then pivoted downward so that the operative end of the instrument 370 contacts the sheet of material. If fashioning head 356 is being used, it is pivoted upward and moved along the guide rod 346 until a desired radial position of its instrument 386 is reached, i.e., a radial position at which a circular cut or line is to be formed. This position may be gleaned by holding the instrument 386 slightly above the sheet of material. The fashioning head 356 is then pivoted downward until a tab 384 is secured in a slot on wall 364 and so that the operative end of the instrument 386 contacts the sheet of material.

Formation of the spiral cut or line and/or circular cut or line via the operative instruments 370 and/or 386 of the fashioning heads 354 and/or 356 then begins by pressing the switch 392 on the housing 310 to actuate the motor 388 and cause rotation of the turntable 328 via engagement of gear 390 with gear ring 338. The fashioning head(s) 354, 356 may be manually held down to increase the pressure being applied to cut, mark or emboss the sheet of material. When the spiral has reached the desired length and/or a complete circular cut or line is formed, the switch 392 is released and rotation of the turntable 328 stops. The actuating arm 330 is released from engagement with the mounting bracket 326B and pivoted upward to enable removal of the fashioned or modified sheet of material.

To aid in maintaining the sheet material on the turntable 328, it is possible to spray a small amount of commercially available tacking material, such as Krylon™, or a commercially available re-positionable spray (e.g., one made by 3M). This temporarily keeps the sheet material on the turntable 28.

Referring now to FIGS. 33-37, a second embodiment of a fashioning device 400 in accordance with the invention is shown and is a variable adjustable spiral-making device in that it is capable of forming a spiral cut or line in a sheet of material. Formation of a line may be considered scribing or embossing the sheet of material. Formation of a cut or line depends on the type of stylus or instrument placed into a receiving slot in the fashioning device 400, such that when a fixed or rotating cutting blade or pen knife is placed into the slot, a spiral cut is formed and when a pen, pencil or other writing instrument is placed into the slot, a spiral line is formed. Placing a blunt head embosser or other type of embossing instrument into the slot enables a spiral embossing to be formed on the sheet of material.

Fashioning device 400 includes a generally circular base plate 402 having a pair of mounting flanges 404, 406 opposite one another, a mounting bracket 408 arranged on mounting flange 404, a gear housing 410 arranged on the other mounting flange 406 and an actuating arm 412 pivotally mounted to mounting flange 404. Stiffening ribs 414 may be arranged on the upper surface of the base plate 402 to provide rigidity thereto. A mounting projection 416 is arranged in the center of the base plate 402 and defines an aperture 418 for receiving a cylindrical projection 420 formed on the underside of a substantially circular turntable 422. The turntable 422 is constructed with a size enabling it to fit between the mounting bracket 408 and the gear housing 410. Also, the turntable 422 may be dimensioned with the same diameter as the base plate 402, e.g., about 12 inches.

The base plate 402, the mounting flanges 404, 406, the stiffening ribs 414 and the mounting projection 416 may be constructed as an integral turntable support unit, or alternatively, one or more of these components can be formed separately and then the components attached together to form a turntable support unit. The mounting bracket 408 and part of the gear housing 410 could also be formed integral with the base plate 402, mounting flanges 404, 406, stiffening ribs 414 and mounting projection 416. Stiffening ribs 414 may extend radially as shown with either a uniform height or taper downward from the center of the base plate 402 toward the edges.

Turntable 422 may be made of the same materials as turntable 328 described above. The upper surface of the turntable 422 can be marked with dimensional markings and possibly provided with a grid-like appearance.

Actuating arm 412 has a latching member 424 at its free end which engages with a projection 426 formed on the gear housing 410. When the actuating arm 412 is lowered from the position shown in FIG. 35, the latching member 424 passes over the projection 426 to thereby secure the actuating arm 412 in a secure position for cutting sheet material placed onto the turntable 422.

Actuating arm 412 includes an elongate frame or support beam 428 having a mounting section 430 at the end of the actuating arm 412 pivotally connected to the mounting bracket 408 and a frame section 432 at the end of the actuating arm 412 which engages with the gear housing 410. A pair of mounting flanges 434 is arranged on the beam 428. A guide rod 436 extends between the mounting flanges 434 and a worm gear 438 is rotatably mounted at one end to a wall of the mounting section 430. At its opposite end, worm gear 438 is rotatably fixed to or formed integral to a gear 440 arranged in the frame section 432 (see FIG. 37).

Figure 33:
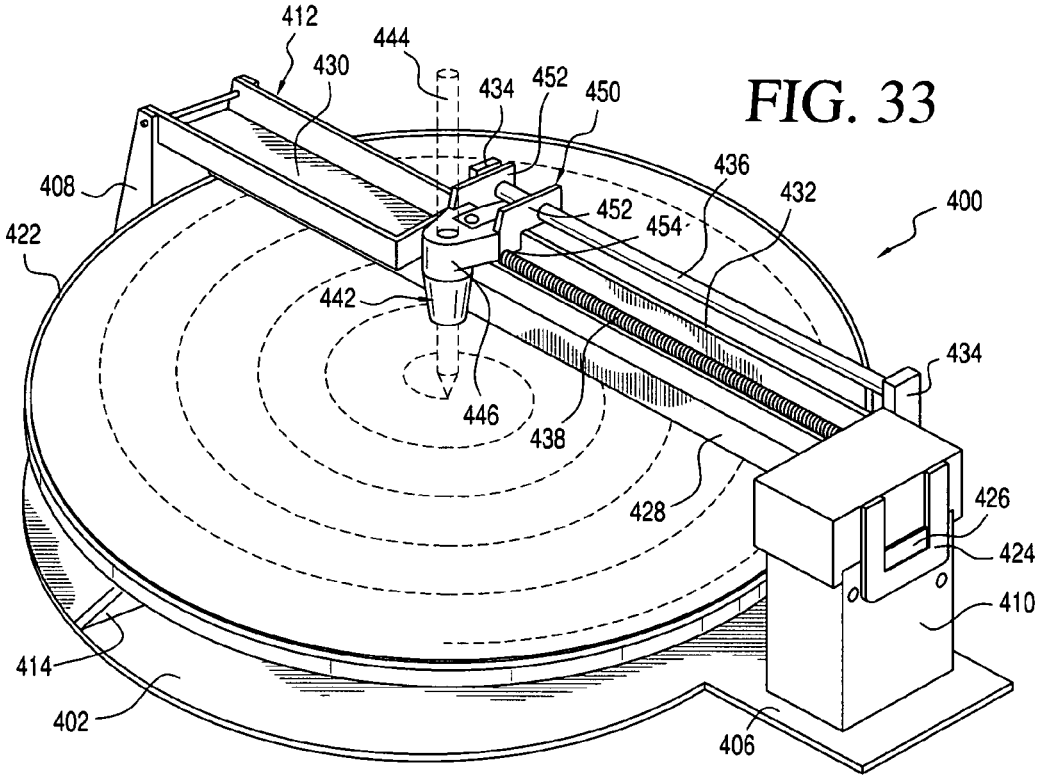
FIG. 33 is a perspective view of a second embodiment of a fashioning device in accordance with the invention.
Figure 34:
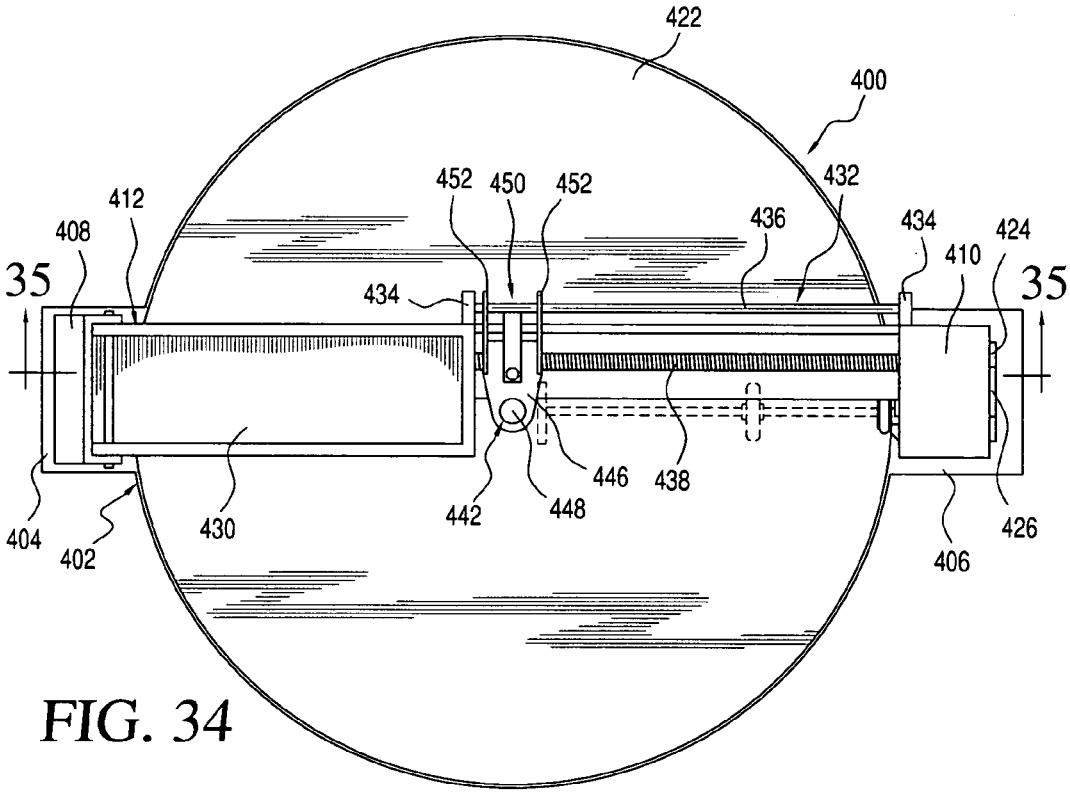
FIG. 34 is a top view of the fashioning device shown in FIG. 33.
Figure 35:
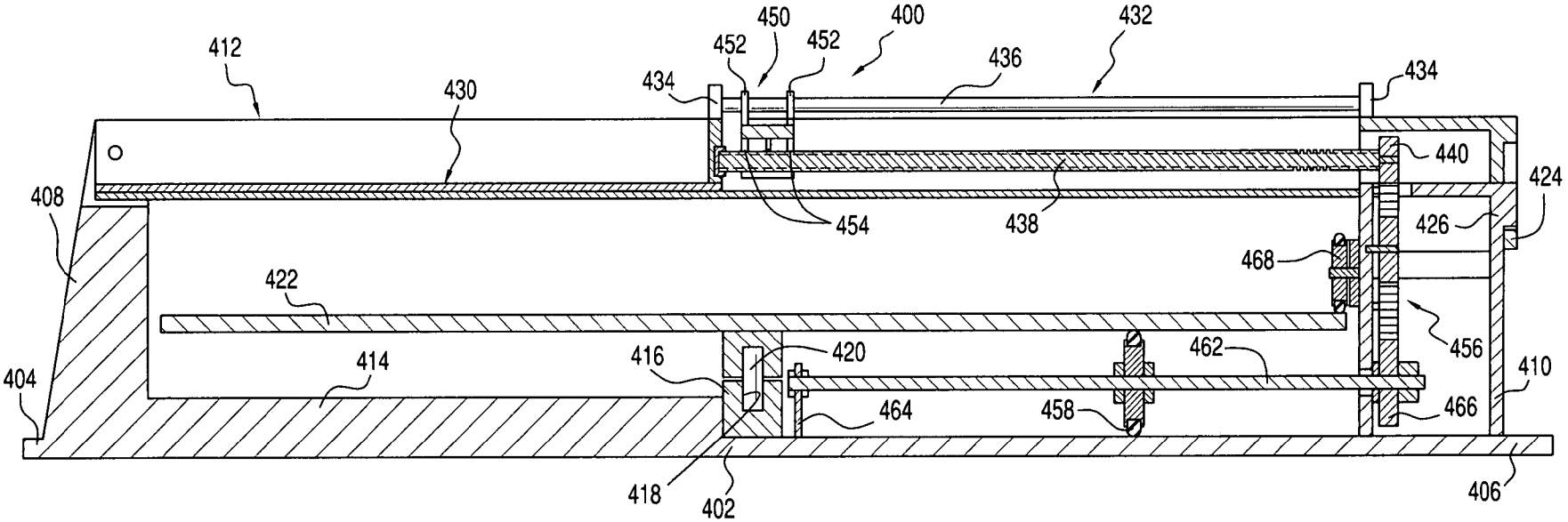
FIG. 35 is a cross-section taken along the line 35-35 in FIG. 34.
Figure 36:
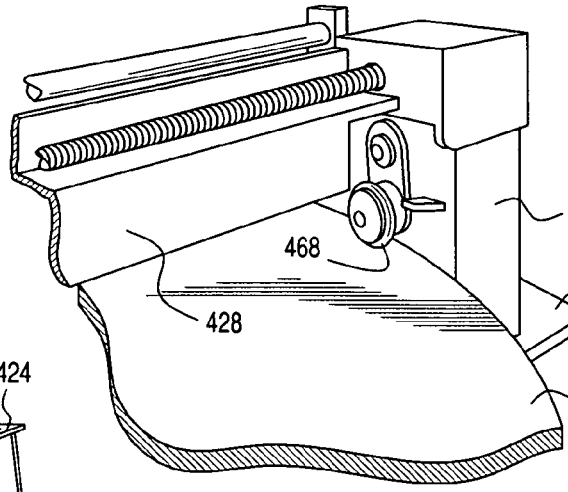
FIG. 36 is a perspective view of a friction ring off the fashioning device shown in FIG. 33.

Actuating arm 412 also includes an instrument holder or fashioning head 442 which holds a cutting, writing or embossing instrument 444 which is designed to contact the sheet material present on the turntable 422 (shown in phantom lines in FIG. 33). Fashioning head 442 includes a retaining section or instrument holder 446 defining a slot 448 in which the instrument 444 is retained and a mounting section 450 including a pair of flanges 452 which rotatably mount the fashioning head 442 to the guide rod 436. One or both flanges 452 includes a curvilinear or arcuate surface 454 which engages with the worm gear 438 so that rotation of the worm gear 438 translates into sliding movement of the fashioning head 442 along the guide rod 436. Lubrication can be provided to facilitate the sliding of the fashioning head 442 along the worm gear 438. Conventional mechanisms for converting or translating rotation of a worm gear into linear movement of a member engaging therewith (i.e., the fashioning head 442 herein) and vice versa can also be used in the invention.

The actuating arm 412 is constructed so that the instrument 444 can be positioned at an approximate centerpoint of the turntable 422. This allows a spiral cut or line to start from or terminate at the center of a sheet of material placed onto the turntable 422 (depending on the direction of rotation of the turntable 422). The start and/or end of the spiral cut or line can be limited by locking members arranged on the actuating arm 412 (such as locking members used to set margins on automatic typewriters). Indeed, the centerpoint of the turntable 422 may be marked and aligned with the instrument 444 when the fashioning head 442 is positioned at its innermost position.

Instrument 444 can be freely insertable into and movable from the slot 448. However, since it is important that the operative end of the instrument 444 be maintained in pressing contact with the turntable 422 during use of the device 400, it should therefore be held down during use. Alternatively, instrument 444 may be retained in the fashioning head 442 using any conventional type of securing device, for example, arranging an adjustment screw to pass through the instrument holder 446 into the slot 448 therein and into engagement with one side of the instrument 444 to press the instrument 444 against an opposite side of the slot 448. Another alternative is to provide a weighting ring which is arranged on the fashioning head 442 and through which the instrument 444 passes. The weighting ring is attached to the instrument 444, e.g., via an adjustment screw, and thus its weight causes the instrument 444 to be maintained in a pressure-exerting position during use.

The fashioning head 442 can be pivoted upward about the guide rod 436 so that each flange 452 is removed from engagement with the worm gear 438. This allows the fashioning head 442 to be moved axially along the guide rod 436, and thus enables the starting point of the spiral cut or line formed by the instrument 444 arranged in connection therewith to be freely selected.

As the fashioning head 442 slides along the guide rod 436, the instrument 444 moves relative to the turntable 422. A spiral cut or line is formed as the turntable 422 rotates while the instrument 444 is rotating relative thereto.

To achieve the formation of a spiral in this manner, a gear arrangement 456 arranged in gear housing 410 connects the gear 440 associated with worm gear 438 to a rotatable disc 458 arranged between the turntable 422 and the base plate 402. Gear arrangement 456 includes a gear 460 which projects upward from the gear housing 410 and is designed to engage gear 440 when the actuating arm 412 is pivoted into engagement with the gear housing 410. Disc 458 is mounted on a shaft 462 and slides along the shaft 462. Shaft 462 is rotatably mounted at one end to a support flange 464 attached to or formed integral with the base plate 402 and at the opposite end to a gear 466 arranged in the gear housing 410 and forming part of the gear arrangement 456. Shaft 462 passes through an aperture in a wall of the gear housing 410 and then into engagement with gear 466. Shaft 462 may be rotatably fixed to gear 466 or formed integral therewith. In view of friction between the disc 458 and the underside of the turntable 422, disc 458 rotates as the turntable 422 is turned or the turntable 422 turns as the disc 458 rotates. This friction is facilitated by the presence of a rotatable friction ring 468 mounted on the gear housing 410 and tensioned to exert pressure downward against the turntable 422.

Gear arrangement 456 converts the rotational movement of the shaft 462 into rotation of the worm gear 438 which translates into linear movement of the fashioning head 442 and vice versa. Thus, there are two ways to form a spiral cut or line, either by manually grasping and rotating the turntable 422, thereby causing linear movement of the fashioning head 442 via the disc 458, shaft 462, gear arrangement 456, gear 440 and worm gear 438, or manually grasping the fashioning head 442 and moving the fashioning head 442 linearly along the worm gear 438 thereby causing rotation of the worm gear 438 and rotation of the turntable 422 via the gear 440, gear arrangement 456, shaft 462 and disc 458.

Instead of requiring a manual force to form a spiral cut or line (either by manually turning the turntable 422 or sliding the fashioning head 442), the turntable 422 may be connected to a motor which causes rotation thereof when a switch is manually activated (as described above with respect to the embodiment shown in FIGS. 28-32). Rotation of the turntable 422 would cause rotation of the disc 458 leading to movement of the fashioning head 442 in the manner described above. Alternatively, a motorized fashioning head 442 may be provided, in which case, linear movement of the fashioning head 442 would cause rotation of the worm gear 438 and rotation of the turntable 422 in the manner described above. Alternatively, a motorized worm gear 438 may be provided, in which case, rotation of the worm gear 438 would cause movement of the fashioning head 442 and rotation of the turntable 422 in the manners described above. Yet another alternative would be to connect one of the gears in the gear arrangement 456 to a motor in which case, as this gear rotates, it would cause both rotation of the turntable 422 via the shaft 462, gear arrangement 456 and disc 458 (and gear 466 if necessary) and rotation of the worm gear 438 (via gear 440) resulting in linear movement of the fashioning head 442.

To enable adjustment of the pitch of a spiral formed by fashioning device 400, the worm gear 438 can be designed to be removable from the actuating arm 412 and replaceable by different worm gears each having a different pitch. A fine pitch of the worm gear will provide a narrow spiral while a coarse pitch of the worm gear will provide a broad spiral. Alternative worm gear arrangements such as discussed above can be used here as well.

Figure 37:
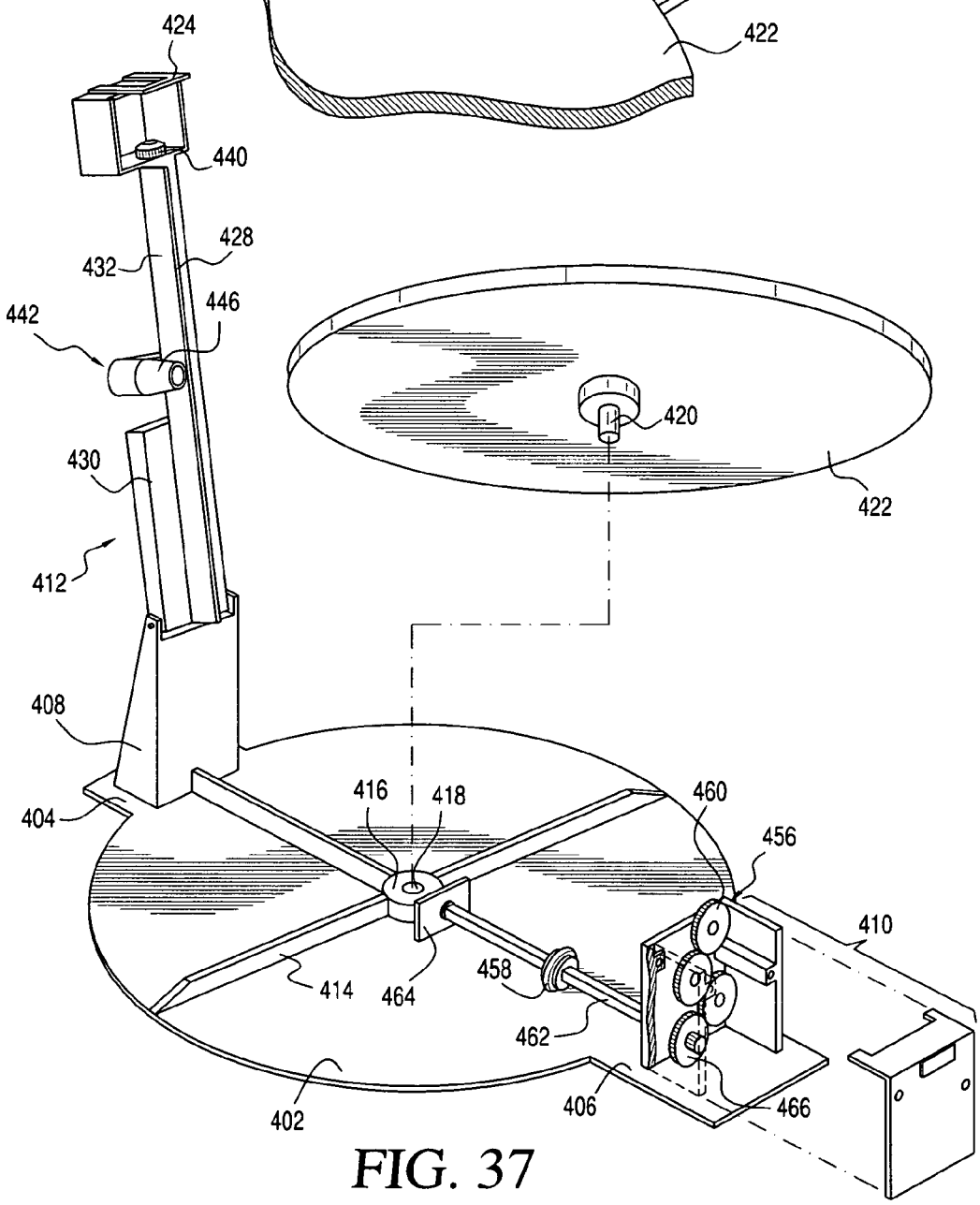
FIG. 37 is an exploded view of the fashioning device shown in FIG. 33.

In an exemplifying but non-limiting use of fashioning device 400, the actuating arm 412 is released from engagement with the gear housing 410 and pivoted upward into the position shown in FIG. 37. A piece of sheet material is placed onto the turntable 422 and the actuating arm 412 is pivoted downward until the latching member 424 snaps over the projection 426 on the gear housing 410. The instrument 444 is placed into the slot 448 in the fashioning head 442 and the fashioning head 442 is pivoted upward about the guide rod 436 and moved along the guide rod 436 until a desired end position of the instrument 444 is reached. This position may be gleaned by holding the instrument 444 slightly above the sheet of material. The fashioning head 442 is then pivoted downward so that the operative end of the instrument 444 contacts the sheet of material. Formation of the spiral cut or line via the instrument 444 then begins either by manually holding and moving the fashioning head 442 along the guide rod 436 or manually grasping and turning the turntable 422. When the spiral has reached the desired length, moving of the fashioning head 442 or turntable 422 is stopped. The actuating arm 412 is then pivoted upward and the sheet of material with the spiral cut or spiral line is removed.

To aid in maintaining the sheet material on the turntable 422, it is possible to spray a small amount of commercially available tacking material or re-positioning spray. This temporarily keeps the sheet material on the turntable 422.

Using the fashioning device 400 in accordance with the invention, it is possible to create a sheet of material having a circular inner area and a spiral cut or line extending outward therefrom, a sheet of material having a spiral cut or line extending inward from a circular edge to the center of the sheet of material, a sheet of material having a spiral cut or line extending inward from a circular edge to a circular inner area and a sheet of material entirely in the form of a spiral with a cut or line separately the convolutions. In combination with the ability to insert different instruments 444 into the fashioning head 442, fashioning device 400 provides a wide range of paper-modifying capabilities.

Figure 38:
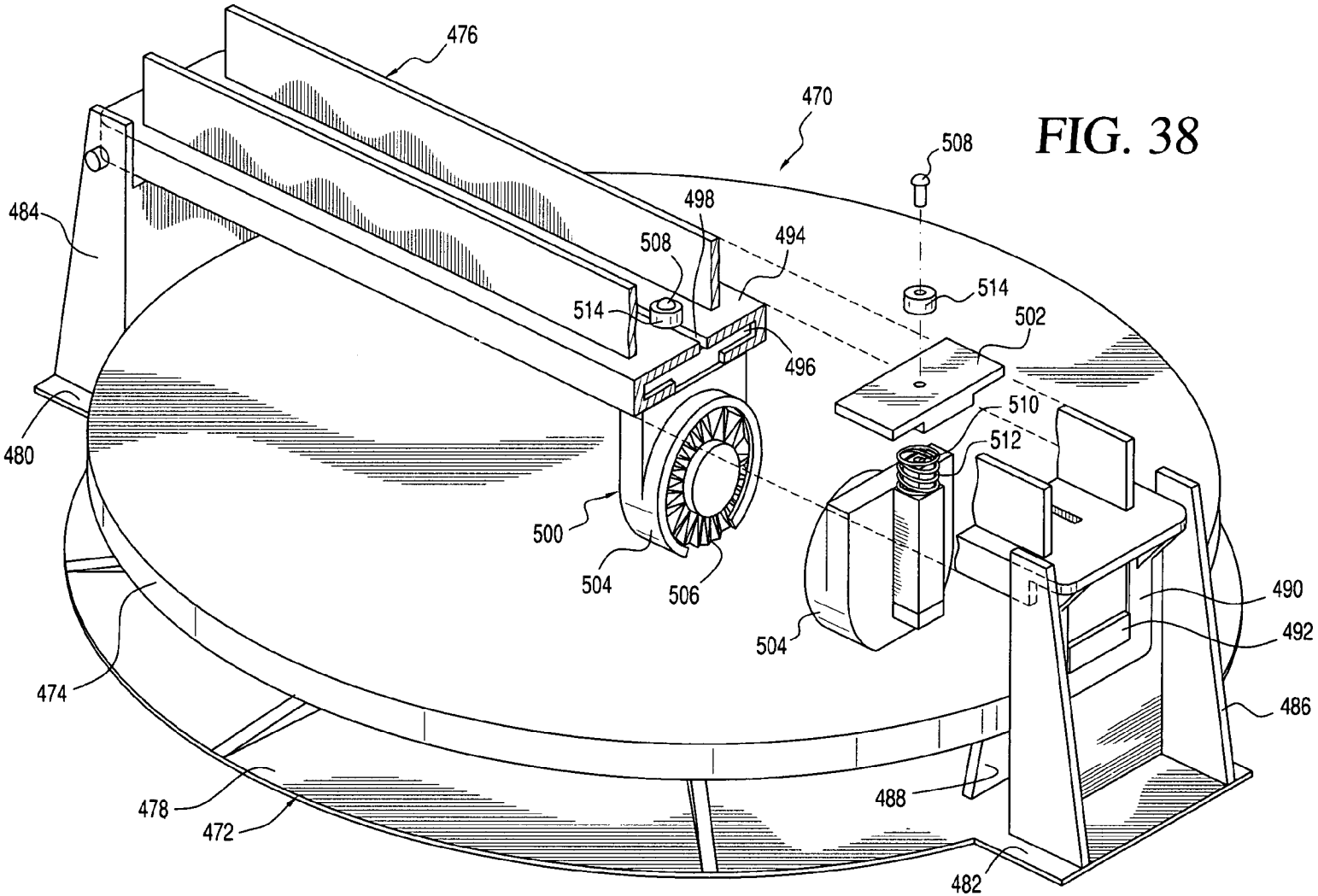
FIG. 38 is partially broken away, perspective view of a third embodiment of a fashioning device in accordance with the invention.

Referring now to FIG. 38, another embodiment of a fashioning device in accordance with the invention is designated generally as 470 and enables the creation of perfect circles and rings of sheet material with varying widths. Fashioning device 470 includes a base 472, a substantially circular turntable 474 rotatably mounted to base 472 and an actuating arm 476 pivotally mounted to the base 472. Base 472 includes a base plate 478 having a pair of mounting flanges 480, 482 diametrically opposite one another, a mounting bracket 484 arranged on mounting flange 480, a mounting bracket 486 arranged on mounting flange 482 and one or more support shoulders or members 488 elevated above the upper surface of the base plate 478 for supporting the turntable 474. Actuating arm 476 is pivotally mounted to mounting bracket 484. Support members 488 preferably each have smooth upper edges, e.g., curvilinear or arcuate upper edges, which provide minimal resistance to the movement of the turntable 474 thereover. By appropriately positioning the support members 488 in both the axial and radial directions, the turntable 474 can be adequately supported during its rotation without causing discernible resistance to its rotation.

Base plate 478 may have a similar construction as base plate 402 described above, e.g., include stiffening ribs and a mounting projection defining an aperture for receiving a cylindrical projection formed on the underside of the turntable 474. Also, the base plate 478, mounting flanges 480, 482, mounting brackets 484, 486 and support members 488 may be constructed as an integral unit or, alternatively, one or more of these components can be formed separately and then the components attached together to form the base.

Turntable 474 may be made of the same materials as turntable 328 described above. The turntable 474 is constructed with a size enabling it to fit between the mounting brackets 484, 486 and optionally with the same diameter as the base plate 478.

Actuating arm 476 has a latching member 490 at its free end which engages with a projection 492 formed on the mounting bracket 486. In the position shown in FIG. 38, the latching member 490 passes over the projection 492 to thereby secure the actuating arm 476 in a position for cutting sheet material placed onto the turntable 474. Alternative securing mechanisms for releasably yet reliably retaining the actuating arm 476 in engagement with mounting bracket 486 can also be used in the invention.

Actuating arm 476 includes an elongate support frame or beam 494 defining a channel 496 and a locking slot 498 communicating with the channel 496.

Spring-action fashioning heads 500 are slidably mounted to the support beam 494 by inserting a mounting member 502 thereof into the channel 496. Fashioning heads 500 also include a body 504 and an actuating instrument, in which case, a circular, rotatable cutting blade 506 attached to the body 504. Cutting blades 506 extend beyond the lower surface of the fashioning heads 500. Movement of the fashioning heads 500 along the support beam 494, and the variable spacing between the fashioning heads 500, allows for varying outer and inner diameters and varying widths of rings being formed using fashioning device 470. It also allows for variable diameter circles capable of being formed using fashioning device 470.

To lock the fashioning heads 500 in different positions along the support beam 494, each fashioning head 500 includes a threaded locking screw 508 which passes through the slot 498, through an aperture in the mounting member 502 into a threaded aperture in a projection 510 formed on the body 504. A shock-absorbing tension spring 512 is interposed between the body 504 and the mounting member 502 and a washer 514 is interposed between the head of the screw 508 and the mounting member 502. In view of the placement of the mounting member 502 in the channel 496 and resting on shoulders of the support beam 494 defining the channel 496, tightening the screw 508 causes the body 504 to be secured to the support beam 494.

The tension spring 512 also serves another purpose in that it presses the cutting blade 506 against the turntable 474 so that the cutting blade 506 can actually penetrate into the material of the turntable 474, i.e., the self-healing material thereof, when it cuts the substrate placed on the turntable 474. Tension springs 512 thereby continually exert a pressing force in a direction toward and against the turntable 474.

Alternative mechanisms for removably attaching the fashioning heads 500 to the support beam 494 include providing an adjustment knob which has a threaded projection designed to pass through the slot 498. This could replace both the locking screw 508 and washer 514. Also, the fashioning heads 500 can be constructed so that the body 504 and mounting member 502 are maintained in connection with the support beam 494 without having the locking screw 508 engaged therewith. In this case, the assembly of the body 504 and mounting member 502 would be freely movable along the support beam 494 and can be locked in different positions by tightening the locking screw 506.

Each cutting blade 506 may have a straight cutting edge to produce smooth-edged cuts or a curved or swiggled cutting edge to produce a wavy or undulating-edged cut. Cutting blades capable of producing other edged-cuts can also be used, e.g., a zig-zag cutting edge. Fashioning heads 500 are preferably designed to accommodate existing cutting blades for rotary cutters such as those made by Fiskars and Olfa Corporation.

Cutting blade 506 can be either fixed to the body 504, in which case, to provide an alternative cutting blade would require removal of the either fashioning head and replacement with another fashioning head having the desired cutting blade, or removably attached to the body 504, e.g., by a locking knob.

Instead of circular, rotatable cutting blades 506, fixed cutting blades or swivel blades can be provided. Such fixed blades may be oriented either perpendicular or at an acute angle, e.g., 45°, to the sheet material. Swivel blades orient themselves in the direction of the cut, i.e., into the cutting direction. As the fashioning head 500 is positioned closer to the center of the turntable 474, the use of swivel blades is more ideal since the use of rotary cutting blades is difficult.

In an exemplifying but non-limiting use of the fashioning device 470, the actuating arm 476 is pivoted upward out of engagement with the mounting bracket 486 and the desired fashioning heads 500 is/are mounted to the support beam 494 (or the desired cutting blades 506 are mounted to the fashioning heads 500 if the cutting blades 506 are replaceable). The fashioning heads 500 are moved along the support beam 494 until they are in the desired radial position and then the locking screws 508 are tightened. A sheet of material to be cut is placed onto the turntable 474. The actuating arm 476 is then pivoted downward so that the latching member 490 passes over the projection 492 on mounting bracket 486 and so that the cutting blades 506 contact the sheet of material. Formation of a ring then begins by manually grasping and turning the turntable 474. During movement of the turntable 474, the cutting blades 506 press the material into the turntable 474 and thereby cut the material. When the ring is complete, movement of the turntable 474 is stopped. The actuating arm 476 is then pivoted upward and the annular ring thus-formed is removed.

Additional uses of the fashioning device 470 with the same cutting blades 506 in different positions is possible by loosening the locking screws 508 while maintaining the fashioning heads 500 on the support beam 494, sliding the fashioning heads 500 to the new, desired positions and then tightening the locking screws 508.

Using the fashioning device 470 in accordance with the invention as shown in FIG. 38, it is possible to create an annular sheet of material with circular inner and outer edges. Such a sheet of material is useful for framing pictures in circular frames or floating frames. The edges of the sheet of material can be straight or wavy depending on the type of cutting blades 506 used.

Although FIG. 38 shows two fashioning heads 500 arranged on the support beam 494, it is possible to use only a single fashioning head. In this case, a circular cut would be formed in the sheet of material, depending on the type of cutting blade used. Moreover, it is possible to mount three, four or even more fashioning heads 500 on the support beam 494 at the same time. If three fashioning heads with cutting blades are used, two rings would be formed while if four fashioning heads with cutting blades are used, three concentric rings would be formed.

Additional variations to fashioning device 470 include the provision of a motor to rotate the turntable 474 or a mechanism for mechanically driving the turntable 474 through the application of tension thereto.

Figure 39:
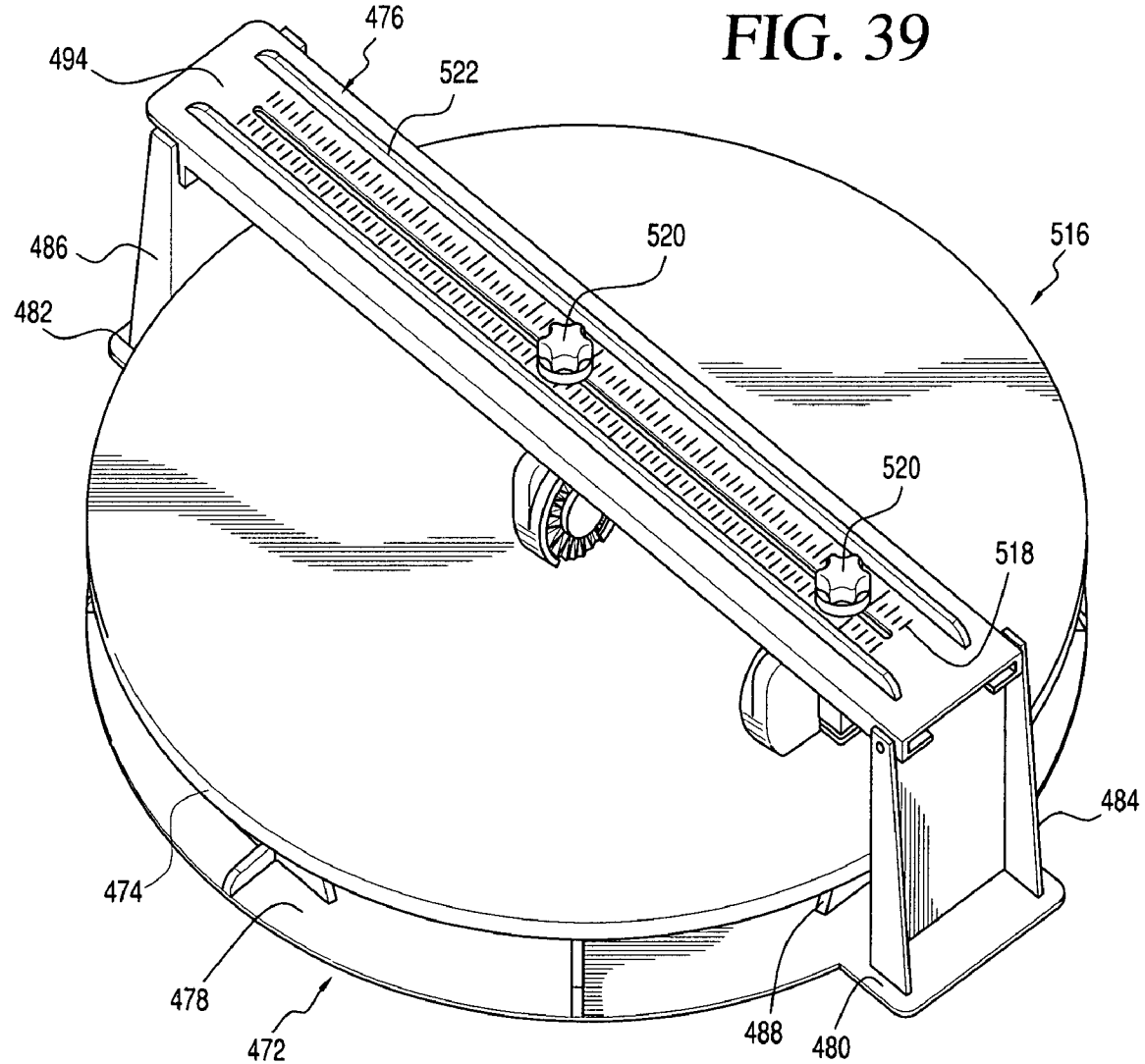
FIG. 39 is a perspective view of a modified third embodiment of the fashioning device shown in FIG. 38.
Figure 40:
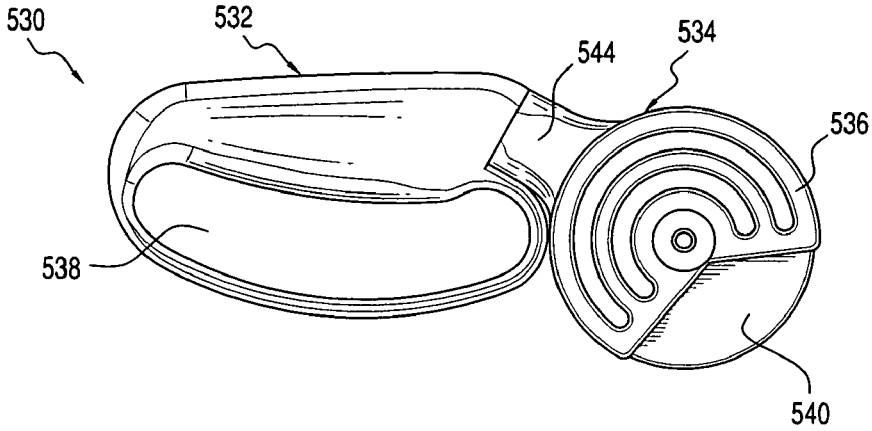
FIG. 40 is a right side view of another embodiment of a hand-held cutting device in accordance with the invention.
Figure 41:
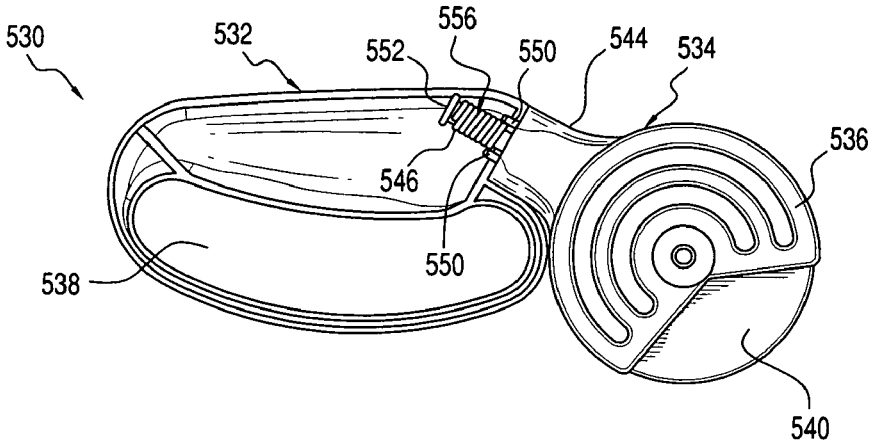
FIG. 41 is a right side view, partially broken away of the cutting device shown in FIG. 40.
Figure 42:
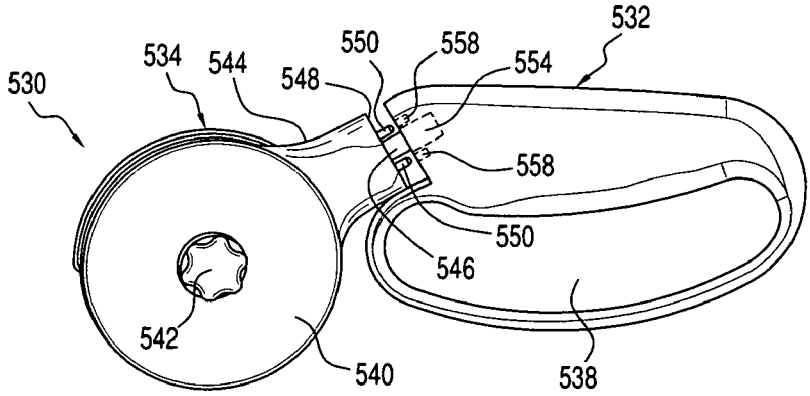
FIG. 42 is a left side view of the cutting device shown in FIG. 40 with the body separated into two parts.
Figure 43:
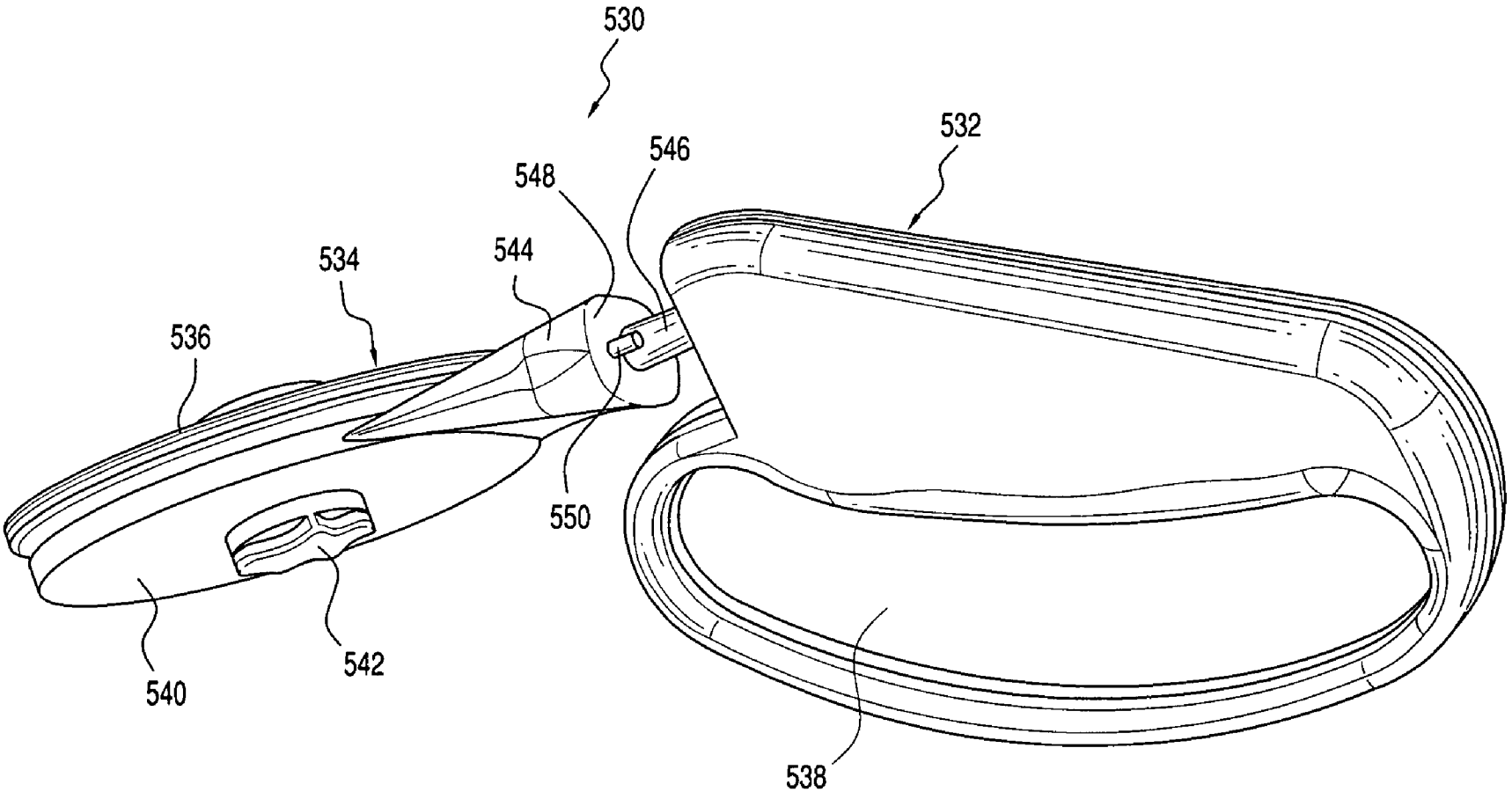
FIG. 43 is a perspective view of the cutting device shown in FIG. 40 during rotation of the cutting portion of the cutting device.

Referring now to FIG. 39, fashioning device 516 is similar to fashioning device 470 and shows a scale 518 provided on the upper surface of the support beam 494. This enables the relative position of the fashioning heads 500 to be determined. For example, the difference between the position of the fashioning heads 500 as determined by viewing the scale 518 corresponds essentially to the thickness of the annular piece of material being cut by the fashioning heads 500 so that if a certain thickness annular piece of material is desired, the fashioning heads 500 can be displaced a corresponding distance apart. Also, a zero point can be provided on the scale 518 so that the distance between the innermost fashioning head 500 and the center of the turntable 174 determined by viewing the scale 518. This could correspond to the inner radius of the piece of material being cut by the fashioning head 500.

Also shown in FIG. 39 are knobs 520 for locking the fashioning heads 500 on the actuating arm 476. Rotating the knobs 520 in one direction causes loosening of the fashioning heads 500 and rotation in the opposite direction causes tightening of the fashioning heads 500. To enable access to the knobs 500, the ribs 522 on the actuating arm 476 are considerably smaller than those in the embodiment shown in FIG. 38.

In the embodiments of the fashioning devices described above, protective or safety features to cover cutting blades or knives when used as instruments are not shown. However, such safety and protective features are within the scope and spirit of the invention and may entail blade sheaths or blade covers as known to those skilled in the art.

Thus, as disclosed above, a general embodiment of a fashioning device for fashioning or modifying a substrate such as a sheet of material in accordance with the invention includes a base, a turntable rotatably arranged on the base for supporting the sheet of material, an actuating arm arranged above the turntable, and at least one fashioning head arranged on the actuating arm and including an instrument adapted to contact the sheet of material when supported by the turntable and which causes a change in the shape, form or design of the sheet of material during rotation of the turntable. Each fashioning head includes or removably receives an instrument which can cut the sheet of material, emboss the sheet of material or scribe or write on the sheet of material. By using various and different fashioning heads and instruments, different patterns of cuts and lines can be formed on the sheet of material during rotation of the turntable, including various spiral cuts and lines and circular cuts and lines and combinations thereof.

To rotate the turntable, a motor may be mounted to the base and a driving gear connected to an output thereof. A switch actuates the motor which is provided power by, e.g., batteries arranged in a compartment defined by the housing. A gear ring is arranged on the turntable and engages with the driving gear to thereby convey rotational force from the motor to the turntable.

Different forms of actuating arms are possible. In one form, the actuating arm includes a frame and a guide rod arranged thereon. Each fashioning head is movably arranged on the guide rod. The actuating arm also includes a rotatable worm gear arranged on the frame. One fashioning head engages with the worm gear such that upon rotation thereof, the fashioning head moves linearly along the guide rod to thereby form a spiral in the sheet of material during rotation of the turntable.

To form circles in the sheet of material, a fashioning head with a fixed radial position is provided. In one embodiment, the fashioning head includes a tab which extends alternatively into one of a plurality of slots in a slotted wall formed on the frame, each slot corresponding to a different radial position of the fashioning head. In another embodiment, the fashioning head includes a locking screw arranged to press against the guide rod to thereby enable the fashioning head to be selectively fixed in position on the guide rod.

The fashioning device may be portable by forming the base as one part of a portable housing with the other part being a cover hingedly connected to the base. The turntable, actuating arm and fashioning head(s) are arranged in an interior of the housing defined between the base and cover. A handle is provided on the housing to carry it, along with a securing mechanism for releasably securing the cover together with the base. The housing can include one or more compartments for storing batteries which are used to provide power to a motor which automatically turns the turntable, substrates for use by the fashioning device and different fashioning heads or instruments for use therewith.

In another embodiment, the base is a substantially planar base plate and the actuating arm includes a support beam, and a guide rod and rotatable worm gear arranged thereon. A fashioning head is movably arranged on the guide rod and engages with the worm gear such that upon rotation of the worm gear, it moves linearly along the guide rod to thereby form a spiral in the substrate during rotation of the turntable. To associate rotation of the turntable to rotation of the worm gear and thus linear movement of the fashioning head, the actuating arm includes a first gear coupled to the worm gear, a shaft is arranged below the turntable, a rotatable disc is arranged on the shaft and frictionally engages with the turntable, a second gear is coupled to the shaft and a gear arrangement connects the first and second gears. As such, manual or automatic rotation of the turntable is converted into linear movement of the fashioning head or manual linear movement of the fashioning head is converted into rotation of the turntable.

By switching the direction of rotation of the turntable, the direction of the spiral cut or line being formed can vary from a cut or line spirally inward to ward the center of the turntable or a spiral cut or line spirally outward toward the edge of the turntable.

In another embodiment of a fashioning device used primary for forming one or more circular lines or cuts in a sheet of material, each fashioning head can be fixed in a radial position during rotation of the turntable. To this end, the actuating arm includes a support beam defining an elongate channel and each fashioning head is slidably mounted to the support beam such that a mounting member thereof is slidable in the channel. Thus, a fashioning device for fashioning a substrate in accordance with this embodiment includes a base, a turntable rotatably arranged on the base for supporting the substrate, an actuating arm arranged above the turntable and including an elongate channel, and at least one fashioning head slidable along the channel and adapted to receive or retain an instrument which operatively contacts the substrate when supported by the turntable and which causes a change in the shape, form or design of the substrate during rotation of the turntable. A locking mechanism is provided to lock each fashioning head in a fixed position along the beam. Each fashioning head preferably includes a tension spring or other similar biasing mechanism for urging the instrument received or retained by the fashioning head against the turntable. The actuating arm is preferably mounted to extend across the turntable, the channel being arranged in the actuating arm to extend across a major portion of the turntable, or at least to enable the fashioning head(s) to be positioned at a range of different radial positions along the turntable.

Referring now to FIGS. 40-43, another embodiment of a cutting device 530 in accordance with the invention is designed to have two different cutting configurations, one for right-handed individuals and the other for left-handed individuals. To this end, the body of the cutting device 530 includes a handle portion 532 and a cutting portion 534 defining a blade-receiving part 536. A front part of blade-receiving part 536 constitutes a blade guard. Handle portion 532 is provided with a contour to conform to a person's hand, i.e., enable a person's fingers to be placed through an opening 538 in the handle portion 532.

Cutting portion 534 includes a rotatable cutting blade 540 housed in the blade-receiving part 536 and a locking knob 542 to secure the cutting blade 540 in a cutting position while also enabling replacement thereof.

Cutting portion 534 is movable into two different positions relative to the handle portion 532. One position is when the cutting device 530 is used by right-handed individuals. Another position is when the cutting device 530 is used by left-handed individuals. To enable alternating between use by a right-handed individual and use by a left-handed individual, the cutting portion 534 is designed to be pulled apart from the handle portion 532 and rotated 180 degrees and then brought into contact with the handle portion 532. The 180 degree rotation causes the contour of the handle portion 532 to switch its orientation relative to the cutting blade 540.

To provide for this alternating use, cutting portion 534 includes a mounting part 544 extending rearward from the blade-receiving portion 536. Mounting part 544 includes a projection 546, which may be cylindrical as shown, extending from a rear-facing surface 548 and a pair of seating pins 550, one on each side of the cylindrical projection 546 (see FIG. 42). Cylindrical projection 546 includes a flange 552 at an inner end arranged in an aperture 554 in the handle portion 532. Seating pins 550 each have a smaller height than the cylindrical projection 546. A spring 556 is arranged around the projection 546 and between the flange 552 and an inner surface of the handle portion 532 around the aperture 554 so that the spring 556 is maintained in the aperture 554. Optionally, the inner end of the spring 556 can be attached to the inner end of the projection 546 in addition to or as an alternative to the formation of the flange 552. The handle portion 532 also includes a pair of cavities 558 alongside the aperture 554 which accommodate the seating pins 550 (see FIG. 42). Cavities 558 are opposite one another.

In use, spring 556 exerts a force against the flange 552 cause the projection 546 to be urged rearward into the aperture 544 so that the rear-facing surface 548 of the mounting part 544 of the cutting portion 534 is urged against the handle portion 532. As a result, the seating pins 550 are retained in the cavities 558. The cutting device 530 can be used as desired. When it is desired to switch the orientation of the cutting device, the cutting portion 534 is pulled outward away from the handle portion 532, i.e., against the bias of the spring 556, until the seating pins 550 are completely removed from the cavities 558, the cutting portion 534 is then twisted sideways (see FIG. 43) and rotated 180 degrees until the seating pins 550 again align with the cavities 558 (but each seating pin 550 will align with the opposite cavity 558). The cutting portion 534 is then released so that the spring 556 urges the cutting portion 534 against the handle portion 532.

The side surfaces 560 of the mounting part 544 are preferably provided with a contour which accommodates the contour of the handle portion 532.

In one variation, a single seating pin 550 can be provided, but still with two cavities 558. Other mechanisms for facilitating position of the cutting portion 534 in the use positions relative to the handle portion 532 can also be provided without deviating from the scope and spirit of the invention.

The foregoing construction of the mechanism for enabling rotation of the cutting portion 534 relative to the handle portion 532 to provide for both right-handed and left-handed use can be applied to the other hand-held cutting devices disclosed herein.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, the actuating arms in the illustrated embodiments of the fashioning devices are pivotably mounted at one end and removably latched to a mounting bracket at the opposite end. It is conceivable that an actuating arm can be constructed in accordance with the invention to be pivotably mounted at one end and also capable of being locked in a position above the turntable via structure arranged at that same end or elsewhere, but not necessarily at the opposite end of the actuating arm.

I claim:

1. A hand-held, portable cutting device for cutting a substrate, comprising:

an elongate body including a handle portion defining an opening through which a user's fingers pass during use of the cutting device;

at least first and second rotatable cutting blades arranged on said body, said first and second cutting blades each being arranged to rotate about a respective rotational axis, said first cutting blade being movable, while in engagement with said body, in a longitudinal direction of said body and relative to said second cutting blade to thereby vary a longitudinal spacing between the rotational axes of said first and second cutting blades;

a third rotatable cutting blade mounted on said body; and first mounting means for mounting said first and third cutting blades to be movable in the longitudinal direction of said body, said first mounting means comprising a longitudinally extending slot formed in said body and a pair of sliding members slidable in the longitudinal direction in said slot, said first and third cutting blades each being mounted to a respective one of said sliding members, said first, second and third cutting blades having a cutting edge arranged on the same side of said body relative to said opening such that when said body is placed against the substrate, all of said first, second and third cutting blades can engage with the same side of the substrate and upon application of manual pressure to said body, said first, second and third cutting blades cut the substrate from the same side; and a respective locking screw arranged to engage with said body and each of said sliding members to thereby lock said sliding member in any one of a plurality of different longitudinal positions relative to said body.

2. The cutting device of claim 1, further comprising second mounting means for mounting said second cutting blade to be movable in a direction transverse to the longitudinal direction of said body.

3. The cutting device of claim 2, wherein said second mounting means comprise at least one projection extending transversely from a side of said body and a blade mounting member to which said second cutting blade is mounted, said blade mounting member being movable along and securable in connection with said at least one projection.

4. The cutting device of claim 3, wherein said at least one projection comprises a guiding projection and a positioning projection, said blade mounting member including an aperture through which said guiding projection passes to guide the transverse movement of said blade mounting member, said positioning projection and said blade mounting member including a cooperating securing mechanism.

5. The cutting device of claim 4, wherein said cooperating securing mechanism is a ridge formed on said blade mounting member and a plurality of tracks formed on said positioning projection, said ridge being selectively and frictionally engageable with each of said tracks to enable said blade mounting member to be positioned at a variable distance from said body and thus said. second cutting blade to be positioned at a variable transverse distance from said first cutting blade.

6. The cutting device of claim 1, wherein said first and second cutting blades are circular.

7. The cutting device of claim 1, wherein said first and second cutting blades are arranged on opposite sides of said body in a direction transverse to the longitudinal direction of said body.

8. The cutting device of claim 1, wherein said slot is a single slot and said sliding members are both slidable in said single slot.

9. The cutting device of claim 1, wherein said second cutting blade is situated in a longitudinal position between said first and third cutting blades such that said first cutting blade is closer to a front end of said body than said second cutting blade and said third cutting blade is closer to a rear end of said body than said second cutting blade.

10. The cutting device of claim 1, wherein said third cutting blade is circular.

* * * * *

UNITED STATES PATENT AND TRADEMARK OFFICE

CERTIFICATE OF CORRECTION

PATENT NO. : 7,591,072 B2
APPLICATION NO. : 11/251642
DATED : September 22, 2009
INVENTOR(S) : David M. Stravitz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 663 days.

Signed and Sealed this

Twenty-first Day of September, 2010

David J. Kappos

David J. Kappos
*Director of the United States Patent and Trademark Office*